US008747618B2

(12) United States Patent
Cabrera y Lopez Caram

(10) Patent No.: US 8,747,618 B2
(45) **Date of Patent: *Jun. 10, 2014**

(54) ENERGY SAVING PAPERMAKING FORMING APPARATUS, SYSTEM, AND METHOD FOR LOWERING CONSISTENCY OF FIBER SUSPENSION

(75) Inventor: Luis Fernando Cabrera y Lopez Caram, Mexico City (MX)

(73) Assignee: FC Papel LLC, Austin, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/554,160

(22) Filed: Jul. 20, 2012

(65) Prior Publication Data

US 2013/0042987 A1 Feb. 21, 2013

Related U.S. Application Data

(60) Provisional application No. 61/510,378, filed on Jul. 21, 2011.

(51) Int. Cl.
*D21F 11/00* (2006.01)

(52) U.S. Cl.
USPC ..... 162/202; 162/208; 162/209; 162/289; 162/351

(58) Field of Classification Search
USPC ..... 162/202, 208, 209, 210, 289, 351, 352, 162/354, 374
See application file for complete search history.

(56) References Cited

U.S. PATENT DOCUMENTS

| | | | |
|---|---|---|---|
| 3,573,159 | A | 3/1971 | Sepall |
| 3,598,694 | A | 8/1971 | Wiebe |
| 3,738,911 | A | 6/1973 | Kienzl et al. |
| 3,823,062 | A | 7/1974 | Ward et al. |
| 3,870,597 | A | 3/1975 | Getman et al. |
| 3,874,998 | A | 4/1975 | Johnson |
| 3,922,190 | A | 11/1975 | Cowan |
| 4,123,322 | A | 10/1978 | Hoult |
| 4,425,189 | A | 1/1984 | Mimura |
| 4,459,176 | A | 7/1984 | Goodnow |
| 4,544,449 | A | 10/1985 | Arav |
| 4,687,549 | A | 8/1987 | Kallmes |
| 4,789,433 | A | 12/1988 | Fuchs |
| 4,838,996 | A | 6/1989 | Kallmes |
| 4,909,906 | A | 3/1990 | Bartelmuss et al. |
| 5,011,577 | A | 4/1991 | Hansen et al. |
| 5,089,090 | A | 2/1992 | Hansen |
| 5,169,500 | A | 12/1992 | Mejdell |
| 5,242,547 | A | 9/1993 | Corbellini et al. |
| 5,387,320 | A | 2/1995 | Jaakkola |

(Continued)

FOREIGN PATENT DOCUMENTS

| | | | |
|---|---|---|---|
| WO | WO 95/30048 | A | 11/1995 |
| WO | WO 2007/088456 | A | 8/2007 |

OTHER PUBLICATIONS

International Search Report and Written Opinion issued by European Patent Office, acting as the International Searching Authority, for corresponding international application PCT/US2012/047566, dated Jan. 28, 2013.

*Primary Examiner* — Mark Halpern
(74) *Attorney, Agent, or Firm* — Frommer Lawrence & Haug LLP; Ronald R. Santucci

(57) ABSTRACT

The present invention is directed to an apparatus used in the formation of paper. More specifically the present invention is directed to an apparatus, system, and method for lowering the consistency or degree of density of fiber suspension on the forming table, and improving the quality and physical properties of the paper formed thereon.

25 Claims, 44 Drawing Sheets

WATER RECIRCULATION SYSTEM IN THE PAPER MACHINE

(56) References Cited

U.S. PATENT DOCUMENTS

| | | | |
|---|---|---|---|
| 5,389,207 | A | 2/1995 | Rodriguez et al. |
| 5,393,382 | A | 2/1995 | Corbellini et al. |
| 5,437,769 | A | 8/1995 | Bando et al. |
| 5,830,322 | A | 11/1998 | Cabrera y Lopez Caram et al. |
| 5,922,173 | A | 7/1999 | Neun et al. |
| 5,951,823 | A | 9/1999 | Cabrera y Lopez Caram et al. |
| 6,126,786 | A | 10/2000 | White et al. |
| 6,375,799 | B1 | 4/2002 | Halmschlager et al. |
| 8,163,136 | B2 | 4/2012 | Cabrera y Lopez Caram |
| 2009/0301677 | A1 | 12/2009 | Cabrera y Lopez Caram |

PRIOR ART

Fig. 1 TABLE ROLL

PRIOR ART

Fig. 2 LOW VACUUM BOX WITH STEP BLADE

Fig. 3 LOW VACUUM BOX WITH STEP BLADE WITH DIRT ACCUMULATION

PRIOR ART

PRIOR ART

Fig. 4 POSITIVE PULSE STEP BLADE
LOW VACUUM BOX

Fig. 5 POSITIVE PULSE BLADE PRIOR ART

Fig. 6 DOUBLE POSITIVE PULSE BLADE

PRIOR ART

Fig. 7 VELOCITY INDUCED DRAINAGE UNIT

Fig. 8 WATER RECIRCULATION SYSTEM IN THE PAPER MACHINE

Fig. 9 HEADBOX FLOW DISCHARGED ON TOP OF FORMING WIRE

| Fig. 10A |
| --- |
| Fig. 10B |

MASS BALANCE 0.8 % CONSISTENCY AT HEADBOX

| | |
| --- | --- |
| MACHINE SPEED | 2,000 FEET PER MINUTE |
| HEADBOX WIDTH | 200 INCH |
| PAPER BASIS WEIGHT | 26 Lbs/1000 SQUARE FT |
| PAPER PRODUCTION AT 10 | 624.0 SHORT TONS PER DAY |

| | |
| --- | --- |
| HEADBOX RECIRCULATION | 5.0 % |
| 1st CLEANING SYSTEM | |
| 1st REJECTS THICKENING FACTOR 1.4HH | |
| REJECTS BE WEIGHT | 2.0 % |
| 2nd CLEANING SYSTEM | |
| REJECTS BY WEIGHT | 10.0 % |
| 2nd REJECTS | |
| THICKENING FACTOR | 4 % |

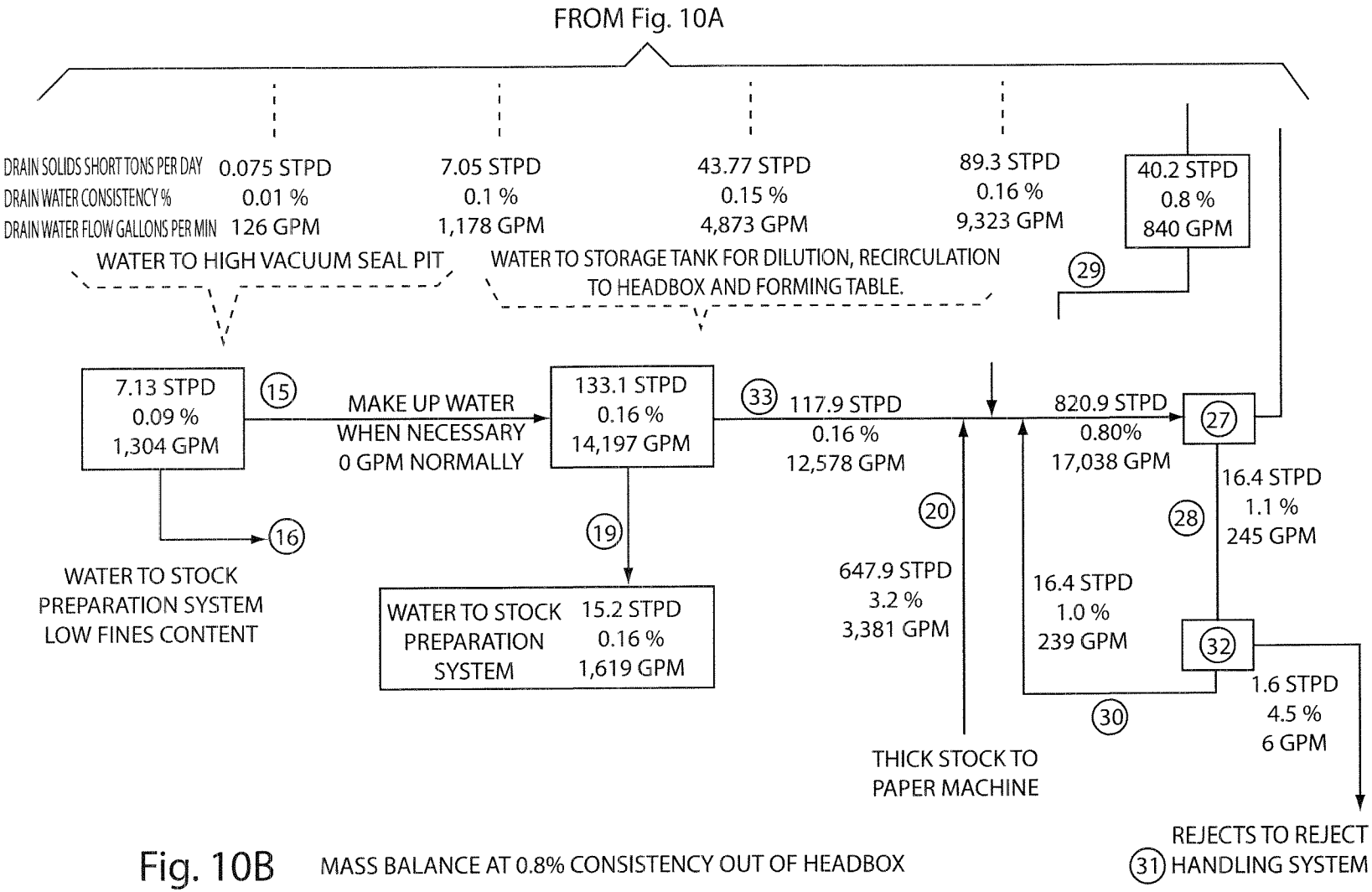
Fig. 10B MASS BALANCE AT 0.8% CONSISTENCY OUT OF HEADBOX

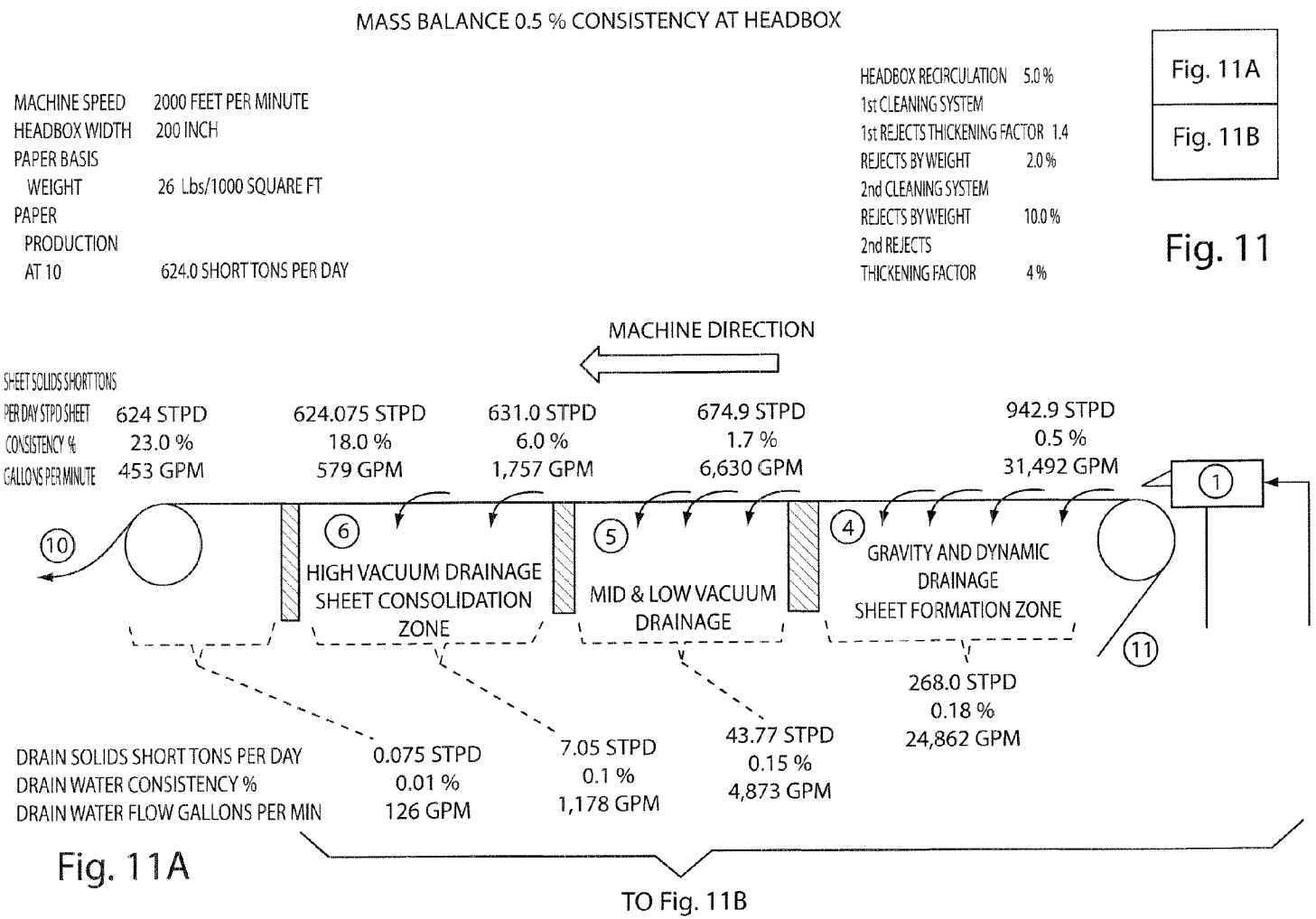
MASS BALANCE 0.5 % CONSISTENCY AT HEADBOX
MACHINE SPEED 2000 FEET PER MINUTE
HEADBOX WIDTH 200 INCH
PAPER BASIS WEIGHT 26 Lbs/1000 SQUARE FT
PAPER PRODUCTION AT 10 624.0 SHORT TONS PER DAY
HEADBOX RECIRCULATION 5.0 %
1st CLEANING SYSTEM
1st REJECTS THICKENING FACTOR 1.4
REJECTS BY WEIGHT 2.0 %
2nd CLEANING SYSTEM
REJECTS BY WEIGHT 10.0 %
2nd REJECTS
THICKENING FACTOR 4 %
Fig. 11A
Fig. 11B
Fig. 11
MACHINE DIRECTION
SHEET SOLIDS SHORT TONS
PER DAY STPD SHEET 624 STPD
CONSISTENCY % 23.0 %
GALLONS PER MINUTE 453 GPM
624.075 STPD
18.0 %
579 GPM
631.0 STPD
6.0 %
1,757 GPM
674.9 STPD
1.7 %
6,630 GPM
942.9 STPD
0.5 %
31,492 GPM
268.0 STPD
0.18 %
24,862 GPM
43.77 STPD
0.15 %
4,873 GPM
7.05 STPD
0.1 %
1,178 GPM
0.075 STPD
0.01 %
126 GPM
HIGH VACUUM DRAINAGE
SHEET CONSOLIDATION
ZONE
MID & LOW VACUUM
DRAINAGE
GRAVITY AND DYNAMIC
DRAINAGE
SHEET FORMATION ZONE
DRAIN SOLIDS SHORT TONS PER DAY
DRAIN WATER CONSISTENCY %
DRAIN WATER FLOW GALLONS PER MIN
TO Fig. 11B
Fig. 11A

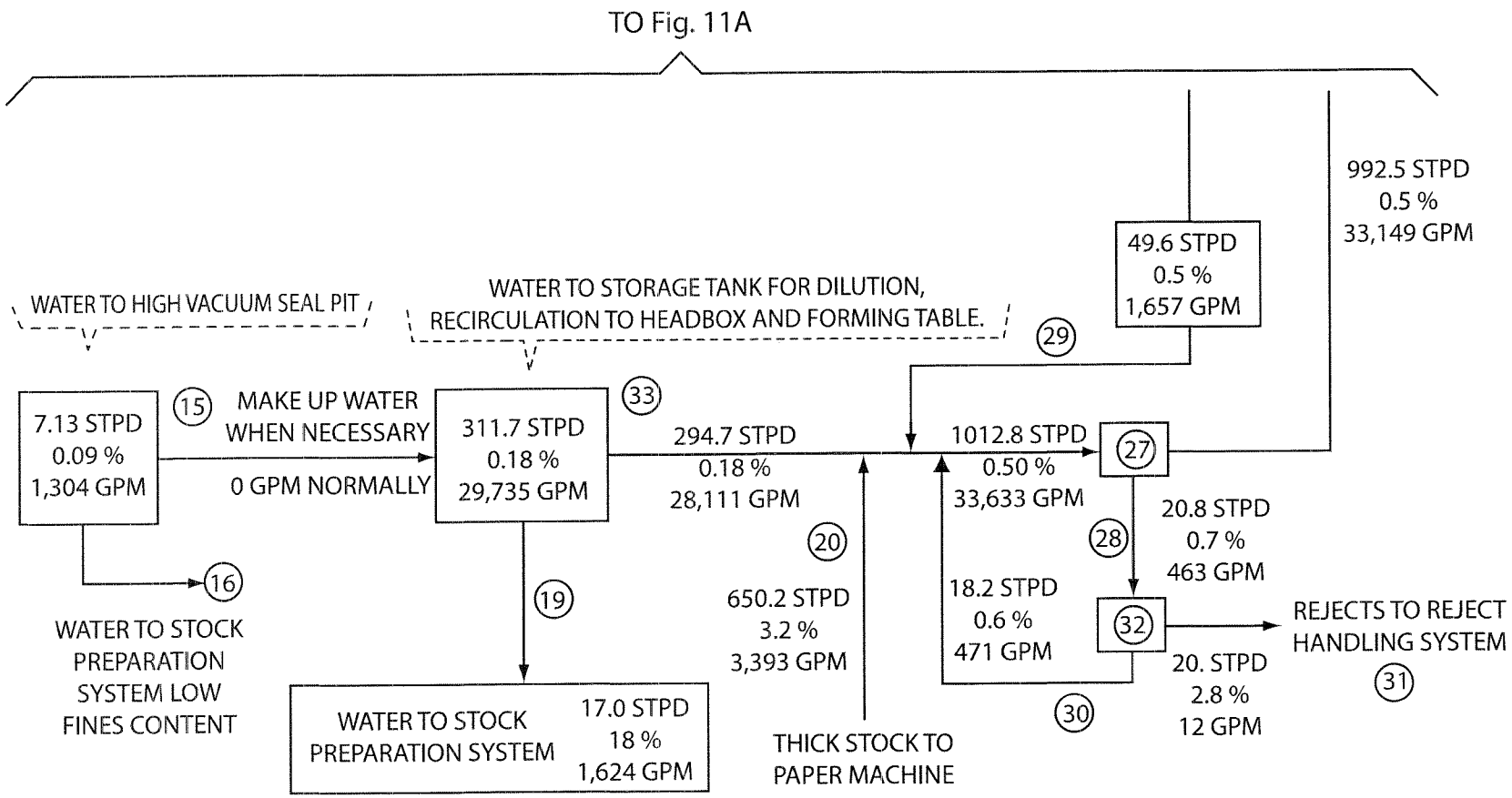
Fig. 11B MASS BALANCE AT 0.5 % CONSISTENCY OUT OF HEADBOX

| Fig. 12A |
| --- |
| Fig. 12B |

MASS BALANCE 0.8 % CONSISTENCY AT HEADBOX

| | |
| --- | --- |
| MACHINE SPEED | 2000 FEET PER MINUTE |
| HEADBOX WIDTH | 200 INCH |
| PAPER BASIS WEIGHT | 26 Lbs/1000 SQUARE FT |
| PAPER PRODUCTION AT 10 | 624.0 SHORT TONS PER DAY |

| | |
| --- | --- |
| HEADBOX RECIRCULATION | 5.0 % |
| 1st CLEANING SYSTEM REJECTS BE WEIGHT | 2.0 % |
| 1st REJECTS THICKENING FACTOR | 1.4 |
| 2nd CLEANING SYSTEM REJECTS BY WEIGHT | 10.0 % |
| 2nd REJECTS THICKENING FACTOR | 4 % |

TO Fig. 12B

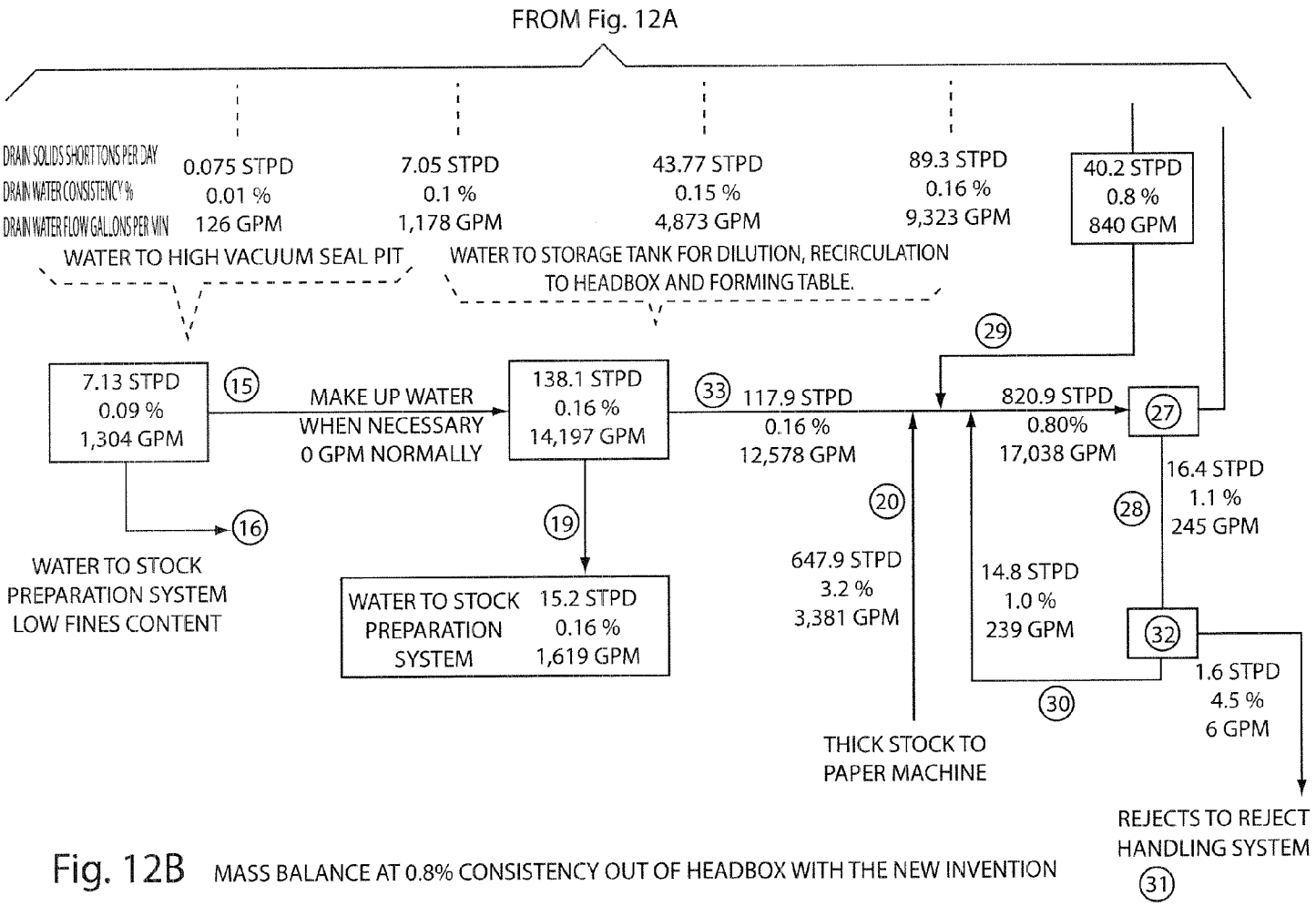
Fig. 12B MASS BALANCE AT 0.8% CONSISTENCY OUT OF HEADBOX WITH THE NEW INVENTION

ENERGY SAVING PAPERMAKING FORMING APPARATUS, SYSTEM, AND METHOD FOR LOWERING CONSISTENCY OF FIBER SUSPENSION

CROSS REFERENCE TO RELATED APPLICATIONS

This application claims priority to U.S. Provisional Patent Application Ser. No. 61/510,378 filed Jul. 21, 2011, which is incorporated by reference herein.

The present application is related to U.S. patent application Ser. No. 13/020,462 filed Feb. 3, 2011, now U.S. Pat. No. 8,163,136 granted Apr. 24, 2012, which claims priority to U.S. Provisional Patent Application Ser. No. 61/423,977 filed Dec. 16, 2010, the entirety of each of which is incorporated by reference herein.

FIELD OF THE INVENTION

The present invention is directed to an apparatus used in the formation of paper. More specifically the present invention is directed to an apparatus, system, and method for lowering the consistency or degree of density of fiber suspension on the forming table, and improving the quality and physical properties of the paper formed thereon.

BACKGROUND OF THE INVENTION

In general, it is well known in the papermaking industry that proper drainage of liquid from the paper stock on a forming fabric is an important step to ensure a quality product. This is done through the use of drainage blades or foils usually located at the wet end of the machine, e.g. a Fourdrinier paper machine. (Note the term drainage blade, as used herein, is meant to include blades or foils that cause drainage or stock activity or both.) A wide variety of different designs for these blades are available today. Typically, these blades provide for a bearing or support surface for the wire or forming fabric with a trailing portion for dewatering, which angles away from the wire. This creates a gap between the blade surface and the fabric, which causes a vacuum between the blade and the fabric. This not only drains water out of the fabric, but also can result in pulling the fabric down due to suction. However, when the vacuum collapses, the fabric returns to its original position, which can result in a pulse across the stock, which may be desirable for stock distribution. The activity (caused by the wire deflection) and the amount of water drained from the sheet are directly related to vacuum generated by the blade. Drainage and activity by such blades can be augmented by placing the blade or blades on a vacuum chamber. The direct relationship between drainage and activity is not desirable because while activity is always desirable, too much drainage early in the sheet formation process may have adverse effects on retention of fibers and filler. Rapid drainage may also cause sheet sealing, making subsequent water removal more difficult. Existing technology forces the paper maker to compromise desired activity in order to slow early drainage.

Drainage can be accomplished by way of a liquid to liquid transfer such as that taught in U.S. Pat. No. 3,823,062 to Ward, which is incorporated herein by reference. This reference teaches the removal of liquid through sudden pressure shocks to the stock. The reference states that controlled liquid to liquid drainage of water from the suspension is less violent than conventional drainage.

A similar type of drainage is taught in U.S. Pat. No. 5,242,547 to Corbellini. This patent teaches preventing the formation of a meniscus (air/water interface) on the surface of the forming fabric opposite the sheet to be drained. This reference achieves this by flooding the vacuum box structure containing the blade(s) and adjusting the draw off of the liquid by a control mechanism. This is referred to as "Submerged Drainage." Improved dewatering is said to occur through the use of sub-atmospheric pressure in the suction box.

In addition to drainage, blades are constructed to purposely create activity in the suspension in order to provide for desirable distribution of the stock. Such a blade is taught, for example, in U.S. Pat. No. 4,789,433 to Fuchs. This reference teaches the use of a wave shaped blade (preferably having a rough dewatering surface) to create micro-turbulence in the fiber suspension.

Other types of blades wish to avoid turbulence, but yet affect drainage, such as that described, for example, in U.S. Pat. No. 4,687,549 to Kallmes. This reference teaches filling the gap between the blade and the web, and states that the absence of air prevents expansion and 'cavitation' of the water in the gap and substantially eliminates any pressure pulses. A number of such blades and other arrangements can be found in the following prior art: U.S. Pat. Nos. 5,951,823; 5,393,382; 5,089,090; 4,838,996; 5,011,577; 4,123,322; 3,874,998; 4,909,906; 3,598,694; 4,459,176; 4,544,449; 4,425,189; 5,437,769; 3,922,190; 5,389,207; 3,870,597; 5,387,320; 3,738,911; 5,169,500 and 5,830,322, which are incorporated herein by reference.

Traditionally, high and low speed paper machines produce different grades of paper with a wide range of basis weights. Sheet forming is a hydromechanical process and the motion of the fibers follow the motion of the fluid because the inertial force of an individual fiber is small compared to the viscous drag in the liquid. Formation and drainage elements affect three principle hydrodynamic processes, which are drainage, stock activity and oriented shear. Liquid is a substance that responds according to shear forces acting in or on it. Drainage is the flow through the wire or fabric, and it is characterized by a flow velocity that is usually time dependant. Stock activity, in an idealized sense, is the random fluctuation in flow velocity in the undrained fiber suspension, and generally appears due to a change in momentum in the flow due to deflection of the forming fabric in response to drainage forces or as being caused by blade configuration. The predominant effect of stock activity is to break down networks and to mobilize fibers in suspension. Oriented shear and stock activity are both shear-producing processes that differ only in their degree of orientation on a fairly large scale, i.e. a scale that is large compared to the size of individual fibers.

Oriented shear is shear flow having a distinct and recognizable pattern in the undrained fiber suspension. Cross Direction ("CD") oriented shear improves both sheet formation and test. The primary mechanism for CD shear (on paper machines that do not shake) is the creation, collapse and subsequent recreation of well defined Machine Direction ("MD") ridges in the stock of the fabric. The source of these ridges may be the headbox rectifier roll, the head box slice lip (see e.g., International Application PCT WO95/30048 published Nov. 9, 1995) or a formation shower. The ridges collapse and reform at constant intervals, depending upon machine speed and the mass above the forming fabric. This is referred to as CD shear inversion. The number of inversions and therefore the effect of CD shear is maximized if the fiber/water slurry maintains the maximum of its original kinetic energy and is subjected to drainage pulses located (in the MD) directly below the natural inversion points.

In any forming system, all these hydrodynamic processes may occur simultaneously. They are generally not uniformly distributed in either time or space, and they are not wholly independent of one another; they interact. In fact, each of these processes contributes in more than one way to the overall system. Thus, while the above-mentioned prior art may contribute to some aspect of the hydrodynamic processes aforesaid, they do not coordinate all processes in a relatively simple and effective way.

Stock activity in the early part of a Fourdrinier table as mentioned earlier is critical to the production of a good sheet of paper. Generally, stock activity can be defined as turbulence in the fiber-water slurry on the forming fabric. This turbulence takes place in all three dimensions. Stock activity plays a major part in developing good formation by impeding stratification of the sheet as it is formed, by breaking up fiber flocks, and by causing fiber orientation to be random.

Typically, stock activity quality is inversely proportional to water removal from the sheet; that is, activity is typically enhanced if the rate of dewatering is retarded or controlled. As water is removed, activity becomes more difficult because the sheet becomes set, the lack of water, which is the primary media in which the activity takes place, becomes scarcer. Good paper machine operation is thus a balance between activity, drainage and shear effect.

The capacity of each forming machine is determined by the forming elements that compose the table. After a forming board, the elements which follow have to drain the remaining water without destroying the mat already formed. The purpose of these elements is to enhance the work done by the previous forming elements.

As the basis weight is increased, the thickness of the mat is increased. With the actual forming/drainage elements it is not possible to maintain a controlled hydraulic pulse strong enough to produce the hydrodynamic processes necessary to make a well-formed sheet of paper.

An example of conventional means for reintroducing drainage water into the fiber stock in order to promote activity and drainage can be seen in FIGS. 1-4.

A table roll 100 in FIG. 1 causes a large positive pressure pulse to be applied to the sheet or fiber stock 96, which results from water 94 under the forming fabric 98 being forced into the incoming nip formed by the lead in roll 92 and forming fabric 98. The amount of water reintroduced is limited to the water adhered to the surface of the roll 92. The positive pulse has a good effect on stock activity; it causes flow perpendicular to the sheet surface. Likewise, on the exiting side of the roll 90, large negative pressures are generated, which greatly motivate drainage and the removal of fines. But reduction of consistency in the mat is not noticeable, so there is little improvement through increase in activity. Table rolls are generally limited to relatively slower machines because the desirable positive pulse transmitted to the heavy basis weight sheets at specific speeds becomes an undesirable positive pulse that disrupts the lighter basis weight sheets at faster speeds.

FIGS. 2 to 4 show low vacuum boxes 84 with different blade arrangements. A gravity foil is also used in low vacuum boxes. These low vacuum augmented units 84 provide the papermaker a tool that significantly affects the process by controlling the applied vacuum and the pulse characteristics. Examples of blade box configurations include:

Step blades 82 as show in FIGS. 2-3; and

Positive pulse step blade 78, as shown in FIG. 4, for example. Traditionally, the foil blade box, the offset plane blade box and the step blade box are mostly used in the forming process.

In use, a vacuum augmented foil blade box will generate vacuum as the gravity foil does, the water is removed continuously without control, and the predominant drainage process is filtration. Typically, there is no refluidization of the mat that is already formed.

In a vacuum augmented flat blade box, a slight positive pulse is generated over the blade/wire contact surface and the pressure exerted on the fiber mat is due only to the vacuum level maintained in the box.

In a vacuum augmented step blade box, as shown in FIG. 2 for example, a variety of pressure profiles are generated depending upon factors such as, step length, span between blades, machine speed, step depth, and vacuum applied. The step blade generates a peak vacuum relative to the square of the machine speed in the early part of the blade, this peak negative pressure causes the water to drain and at the same time the wire is deflected toward the step direction, part of the already drained water is forced to move back into the mat refluidizing the fibers and breaking up the flocks due to the resulting shear forces. If the applied vacuum is higher than necessary, the wire is forced to contact the step of the blade, as shown in FIG. 2. After some time of operation in such a condition, the foil accumulates dirt 76 in the step, losing the hydraulic pulse which is reduced to the minimum, as shown in FIG. 3, and prevents the reintroduction of water into the mat.

The vacuum augmented positive pulse step blade low vacuum box, as shown in FIG. 4, fluidizes the sheet by having each blade reintroduce part of the water removed by the preceding blade back into the mat. There is, however, no control on the amount of water reintroduced into the sheet.

Positive pulse blade, as water drains through the fabric, a converging nip produced by the lead angle of the blade and the fabric forces the water back into the sheet. This produces a shear force capable of breaking the fiber mat and penetrating through the stock slurry, re-fluidizing of the slurry is minimum, as it is shown in FIG. 5, for example.

A special type of double posi-blade incorporates a positive incoming nip to generate a positive and negative pressure pulse. This blade reintroduces water to the fiber mat with the lead in edge, the water reintroduced is limited to the amount adhere to the bottom of the forming fabric. This type of blade creates pressure pulses rather than consistency reduction. This type of blade simulates a table roll, as it is shown in FIG. 6, for example.

U.S. Pat. No. 5,830,322 to Cabrera et al., filed February 1996, titled "Velocity induced drainage method and unit" describes an alternate means of creating activity and drainage. The apparatus described therein decouples activity and drainage and thus presents a means of controlling and optimizing them. It uses a long blade with a controlled, probably non-flat or partially non-flat surface to induce initial activity in the sheet, and limits the flow after the blade through placement of a trail blade to control drainage. The '322 patent discloses that drainage is enhanced if the area between the long blade and forming fabric is flooded and surface tension is maintained between the water above and below the fabric. The invention disclosed therein is shown schematically in FIG. 7, for example.

However, with the '322 patent there is only one way to reintroduce a minimum amount of water to the fiber suspension. It occurs in the "counterflow zone," and exists because the incompressible fluid follows the non-flat top of the long blade and is thus pumped through the forming fabric. The consistency that reaches the lead in edge of the Velocity Induce Unit does not change along the same blade. The stock consistency will be increased when the stock reaches the trial blade, because of drained water in the slot, if the Velocity Induce Unit is designed with multiple long blades and the consistency is constantly increased along the Velocity Induce Unit.

While some of the foregoing references have certain attendant advantages, further improvements and/or alternative forms, are always desirable.

SUMMARY OF THE INVENTION

Stock dilution on the forming section of the paper machine is critical to the production of a good sheet of paper. Generally, stock dilution is achieved at the short loop system of the forming section of the machine by increasing the recirculation of the white water.

Stock dilution on the forming table plays a major part in developing good formation, facilitates the realization of the three hydrodynamic processes necessary to make a well-formed sheet of paper; allowing the fiber orientation to be random.

Most of the paper machines have been sped up in order to increase production and have lower consistencies for better paper quality and still have the same machine screen, same piping and same headbox to supply water and stock to the forming table. The forming tables have been reworked in order to take care of the excessive flow.

Let us suppose as an example a paper machine originally designed with a headbox 200 inches wide, at a speed of 800 feet per min with a headbox consistency of 0.65%, making paper of 54 grams per square meter and a retention of 70%; the calculated flow out of the headbox will be about 3927 Gallons per minute. However, over the years the machine has increased the speed 1.75 times and the headbox consistency has been lowered for better quality to 0.38%, the retention has dropped to 65%; the flow out of the headbox is now about 12660 Gallons per minute. The flow has increased 3.22 times and as a result all internal velocities in the entire system have more than tripled, which may have harmful results.

Therefore, when working at low consistencies or when the paper machine is sped up, it is necessary to increase the number of drainage elements, because of the increased flow out of headbox. In some instances it is also necessary to increase the longitude of the table in order to make space for the installation of additional drainage equipment or to install new vacuum assisted drainage equipment.

However, due to the present invention, it is not necessary to increase the longitude of the table or to install new vacuum assisted drainage equipment. Additionally, there is a considerable reduction of energy consumption on the forming table.

Accordingly, an object of the present invention is to provide a machine for maintaining the hydrodynamic processes on the forming table irrespective of what the machine speed.

It is a further object of the present invention to provide a machine usable with a forming board and or a velocity induced drainage machine.

It is a further object of the present invention that the efficiency of the machine not be affected by the velocity of the machine, the basis weight of the paper sheet and or the thickness of the mat.

The present invention describes a machine that recycles the water by itself in order to dilute the fiber suspension on the table to the desired levels after the head box; the dilution rate of the present invention may be anything between 0% to 100%; the work done by the machine in the present invention is not affected by the degree of refining, velocity of the machine, the basis weight of the paper sheet or the thickness of the mat. After the sheet has been formed by the present invention, the drainage and the consolidation of the sheet is done by the equipment in continuation.

Paper making chemicals as known to those of ordinary skill in the art can be added to fiber suspension in order to enhance paper strength and machine productivity. All paper chemicals are added before or after the forming table.

One exemplary embodiment of the present invention is an apparatus for lowering consistency or degree of density of fiber contained in a liquid suspension on a forming table of a papermaking machine, the apparatus comprising at least one conduit for adding paper making chemicals into a flow of liquid to form a mixed flow, a forming fabric on which a fiber slurry is conveyed, the forming fabric having an outer surface and an inner surface, and a primary blade having a leading edge support surface that is in sliding contact with the inner surface of the forming fabric, a central plate that comprises at least a portion of self dilution, shear, microactivity or drainage section of the forming table, wherein the central plate is separated from a bottom plate by a predetermined distance to form a channel for recirculation of at least a portion of the liquid. The papermaking machine is configured such that mixed flow including a drained liquid to be re-used in at least a part of the forming process.

Another exemplary embodiment of the present invention is a system for lowering consistency or degree of density of fiber contained in a liquid suspension on a forming table of a papermaking machine, the system comprising an apparatus comprising at least one conduit for adding paper making chemicals into a flow of liquid to form a mixed flow, a forming fabric on which a fiber slurry is conveyed, the forming fabric having an outer surface and an inner surface, a primary blade having a leading edge support surface that is in sliding contact with the inner surface of the forming fabric, a central plate that comprises at least a portion of self dilution, shear, microactivity or drainage section of the forming table, wherein the central plate is separated from a bottom plate by a predetermined distance to form a channel for recirculation of at least a portion of the liquid. The papermaking machine such that mixed flow including a adrained liquid can be re-used in at least a part of the forming process.

Another exemplary embodiment of the present invention is a method for lowering consistency or degree of density of fiber suspension on a forming table of a papermaking machine, the method comprising the steps of providing a forming fabric on which a fiber slurry is conveyed, the forming fabric having an outer surface and an inner surface, providing a primary blade having a leading edge support surface that is in sliding contact with the inner surface of the forming fabric, and providing a central plate that comprises at least a portion of self dilution, shear, microactivity or drainage section of the forming table, wherein the central plate is separated from a bottom plate of the forming table by a predetermined distance to form a channel for recirculation of at least a portion of the liquid.

The various features of novelty which characterize the invention are pointed out in particularity in the following description of preferred embodiments. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

The following detailed description, given by way of example and not intended to limit the present invention solely thereto, will best be appreciated in conjunction with the accompanying drawings, wherein like reference numerals denote like elements and parts, in which:

FIG. 11 Depicts mass balance at 0.5% consistency out of headbox;

DETAILED DESCRIPTION OF THE PRESENT INVENTION

Figure 1:
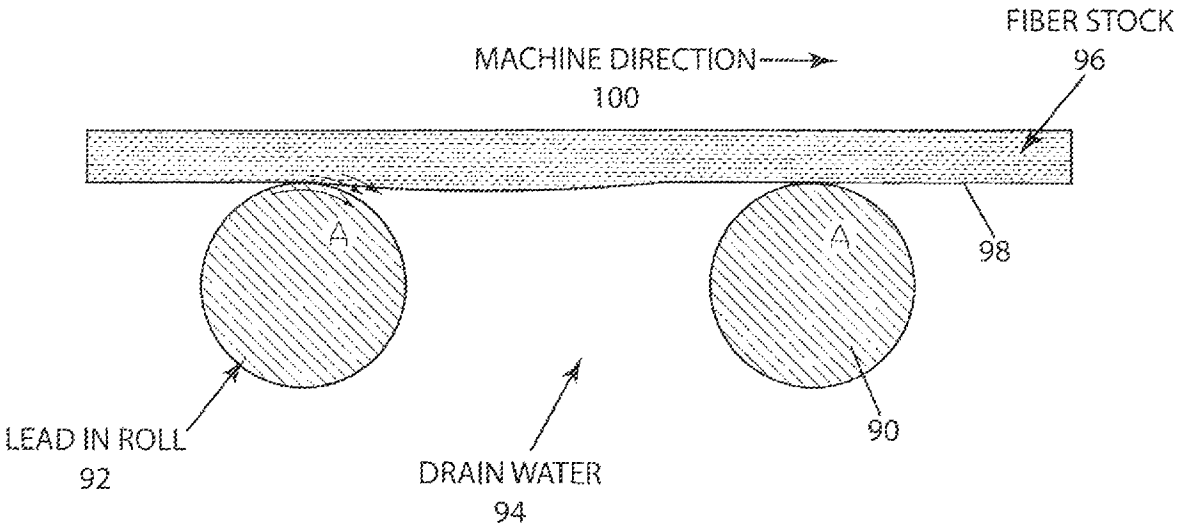
FIG. 1 Depicts a known table roll.
Figure 2:
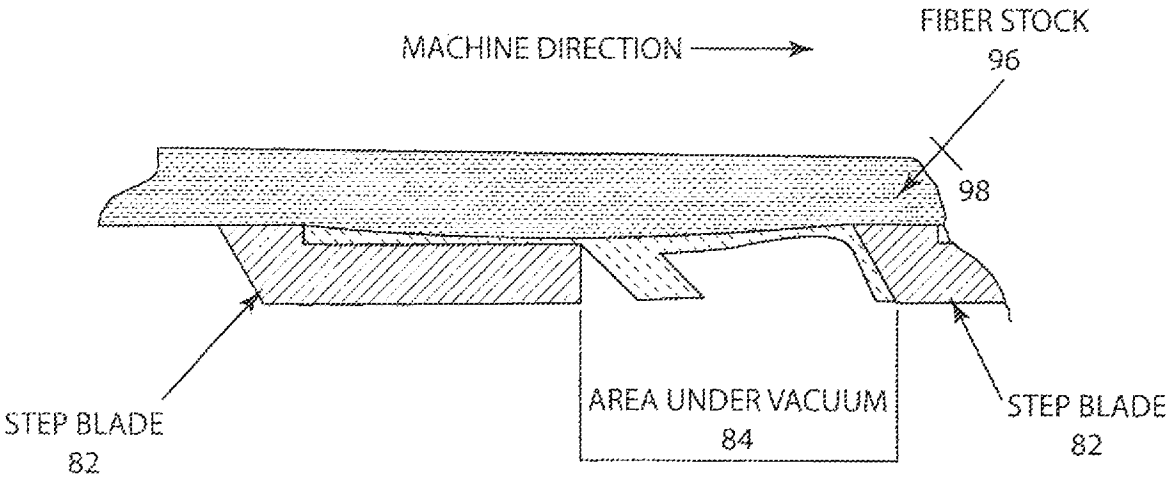
FIG. 2 Depicts a known low-vacuum box with step blade.
Figure 3:
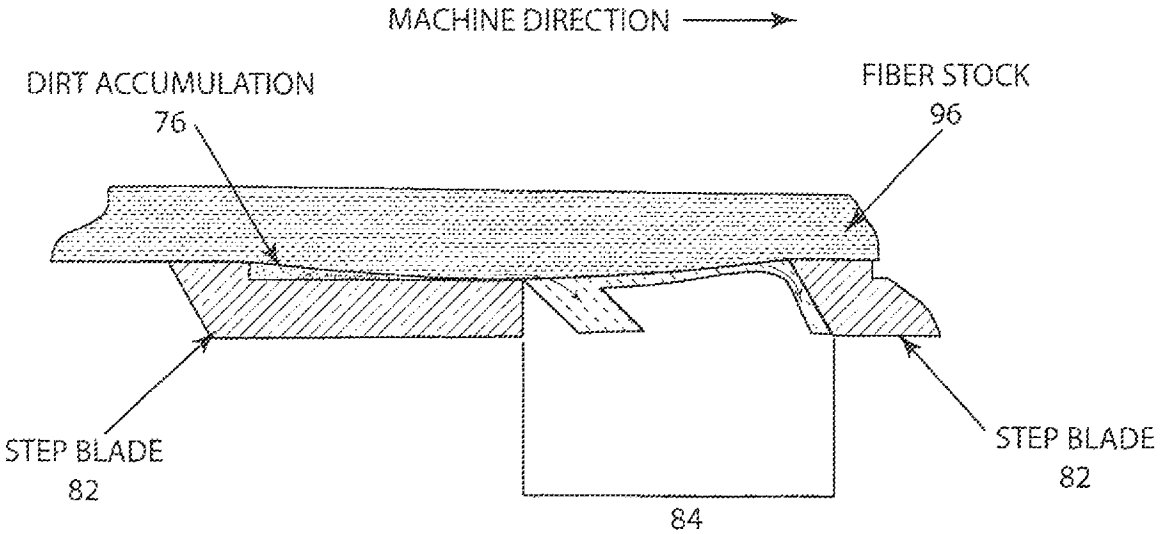
FIG. 3 Depicts a known low-vacuum box, step blade with dirt accumulation.
Figure 4:
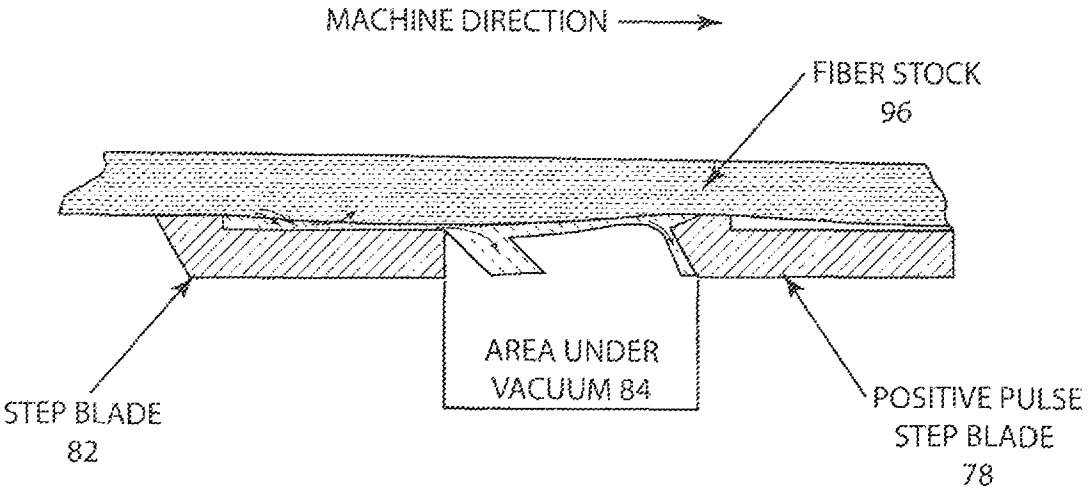
FIG. 4 Depicts a known positive pulse blade low vacuum box.
Figure 5:
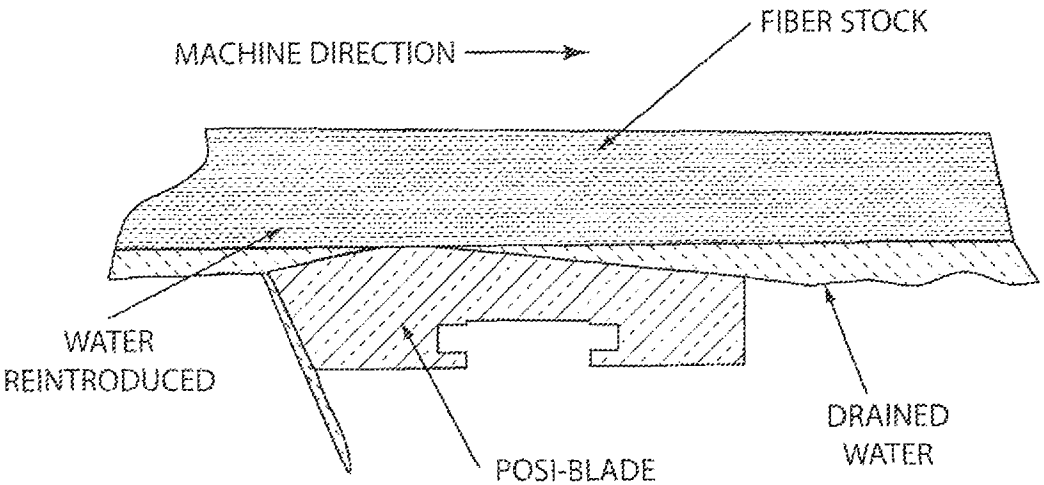
FIG. 5 Depicts a known positive pulse blade.
Figure 6:
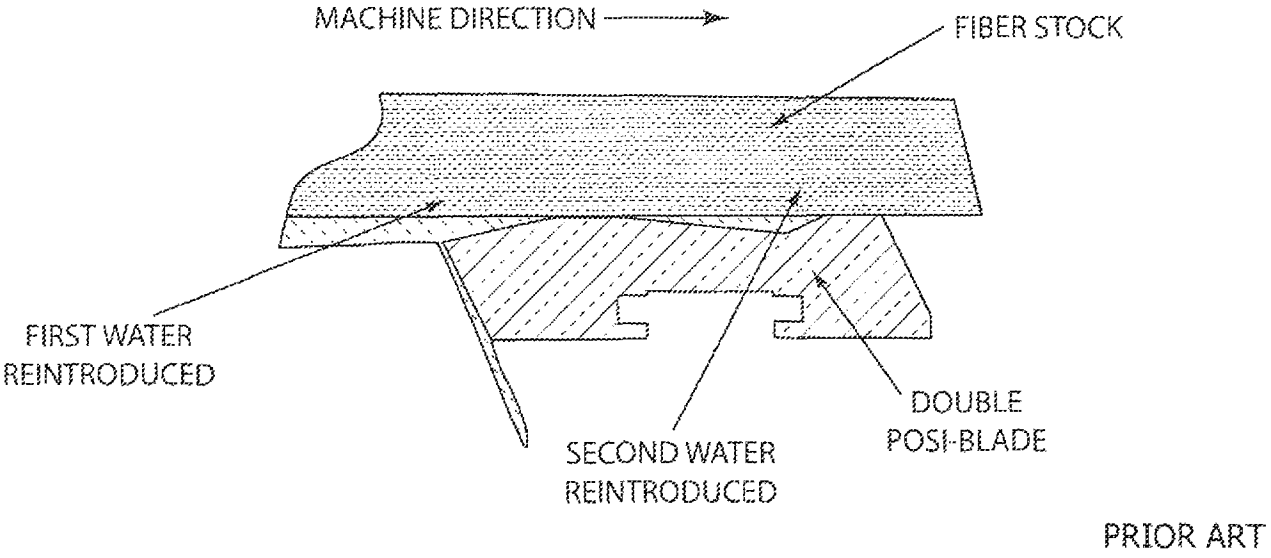
FIG. 6 Depicts a known double positive pulse blade.
Figure 7:
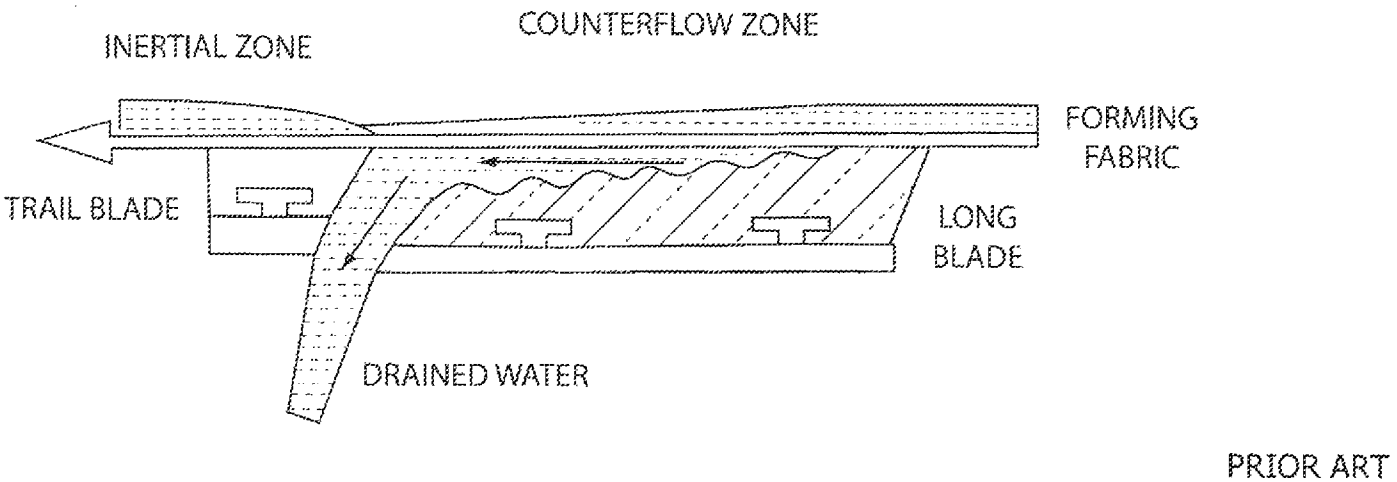
FIG. 7 Depicts a known velocity induced drainage unit.
Figure 8:
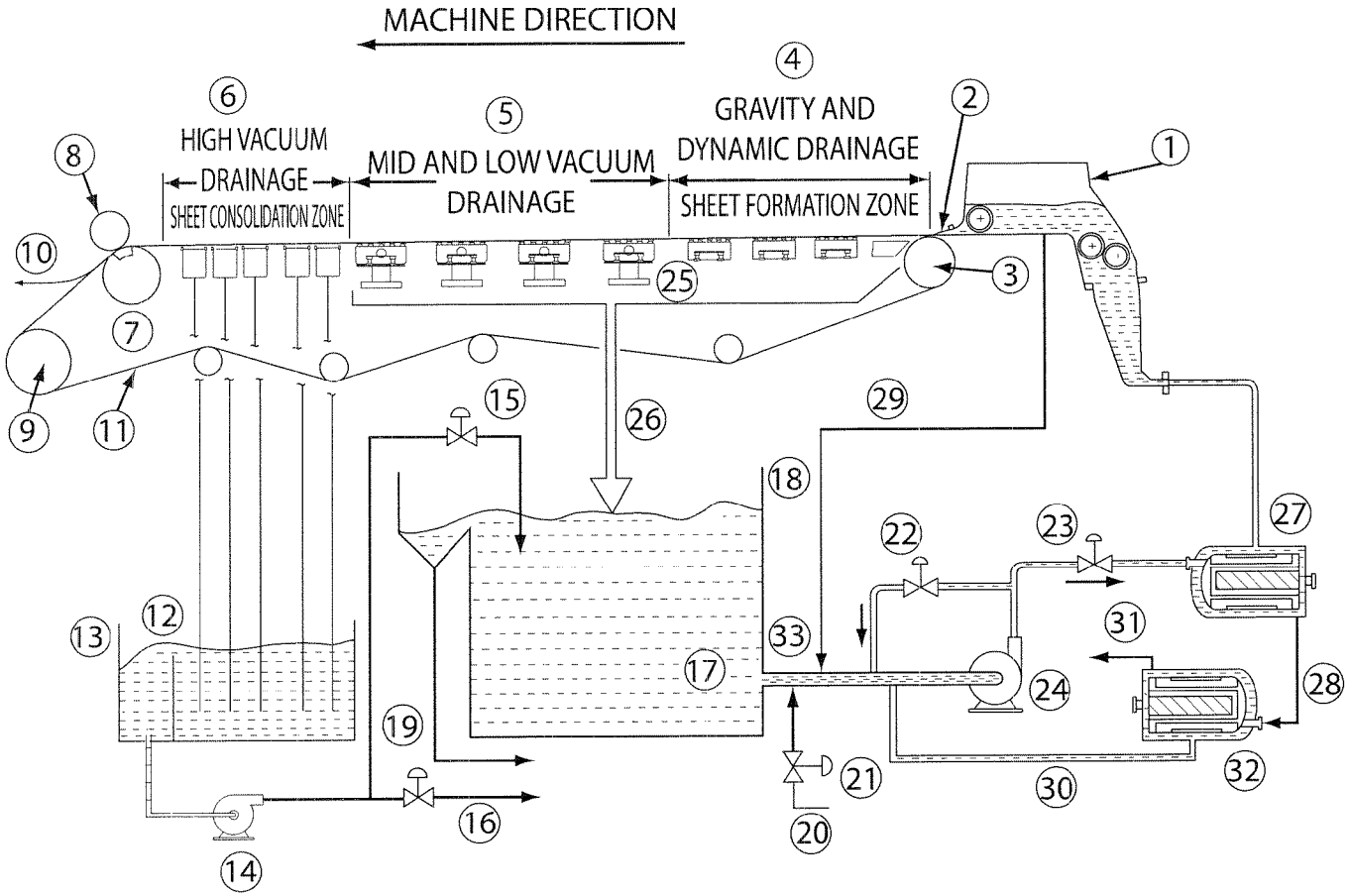
FIG. 8 Depicts a water recirculation system in a paper machine.

All devices already described as a part of the previous art are part of or form the gravity and dynamic drainage zone or sheet formation zone 4 shown in FIG. 8.

Shown in FIG. 8 is a system that is capable of reducing consistency at any level on the forming table. Thick stock 20, often having a consistency of about 1 to 5% is diluted with white water 17 at the inlet 33 of the fan pump 24; the necessary amount of thick stock is controlled by valve 21. The fan pump 24 propels the dilute slurry of papermaking furnish towards the cleaning system 27 which removes all debris and non desirable objects 28, and the clean stock is sent to headbox 1 of the paper machine. The consistency of thin-stock furnish coming out of the cleaning system 27 and 32 is typically between 0.1% and 1% solids.

Fan pump 24 and cleaning system 27 and 32 are typically located in the basement underneath the forming section of the paper machine. The stock is delivered from the headbox 1 onto the Fourdrinier wire 11 through a slice 2. The total flow discharged over the forming wire 11 by the slice lip 2 of the head box 1, is controlled by changing the revolutions of the fan pump 24 and by adjusting the valves 23 and 22, when more flow is necessary the an pump 24 increases the revolutions and valve 23 increases the opening, valve 22 is adjusted to fine tune the required flow. In some installations the fan pump 24 has a constant speed motor in order to increase or decrease the flow out of the pump; in this case it is necessary to adjust valves 23 and 22.

The wet sheet 10 is actually formed on the Fourdrinier table that consists essentially of endless forming mesh belt 11 which is supported in zones 4, 5 and 6 by forming, and drainage devices which make up the wet end of the paper machine.

Close to the headbox 1, the forming mesh is supported by the breast roll 3, which is followed by forming, and drainage devices in zones 4, 5. The endless forming mesh moves over several suction boxes in zone 6 before it returns over a suction couch roll 7 and drive roil 9.

Water is quantitatively the most important raw material of papermaking. Before the stock is discharged on the forming mesh 11 of the forming table, it is very dilute; its fiber content is probably as low as 0.1%. From this point on, water removal becomes one of the most decisive functions of the machine. The stock out of the headbox 1 contains other solids in addition to fibers, due to which it has approximately 0.5 percent consistency; and the fiber mat 10 out of the couch 7 has between 23 and 25 percent consistency.

However, that in order to reduce viscosity of the water and drain the water properly, it is necessary to heat the fiber slurry in the range of 135 to 140 degree Fahrenheit. During this process, it is normal to have heat losses in the range of 5 to 10 degree Fahrenheit.

Figure 9:
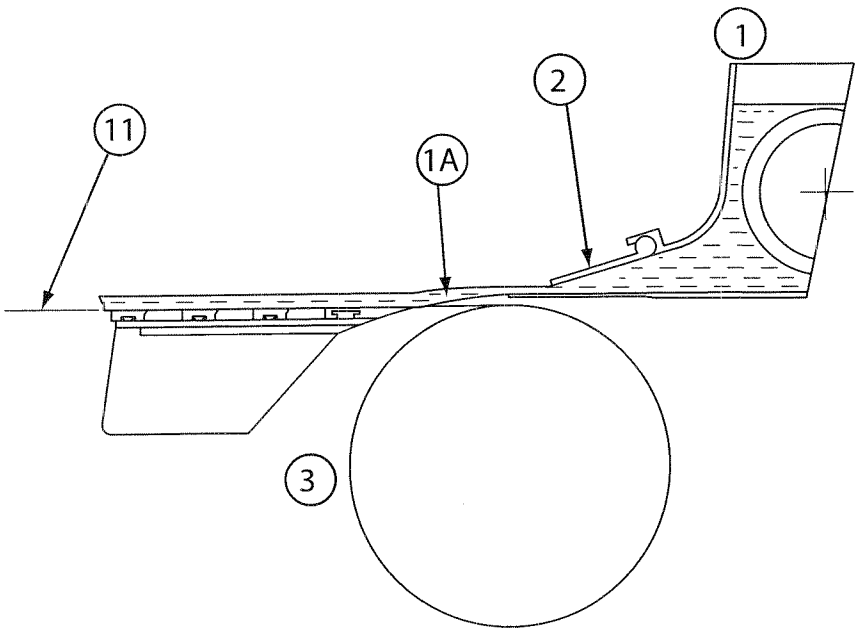
FIG. 9 Depicts headbox flow discharged on top of a forming wire.

Referring now to FIG. 9, fiber flow 1A having consistency between 0.1% and 1% is discharged out of the headbox 1 through the headbox slice lip 2 onto a moving forming mesh 11. The discharged velocity ratio (flow velocity divided by mesh velocity) between the fiber flow 1A and the forming mesh 11 is normally in the range of 0.6 to 1.3. However, these machines can operate at speeds greater than 3,000 feet per minute.

Figures 10, 10A:
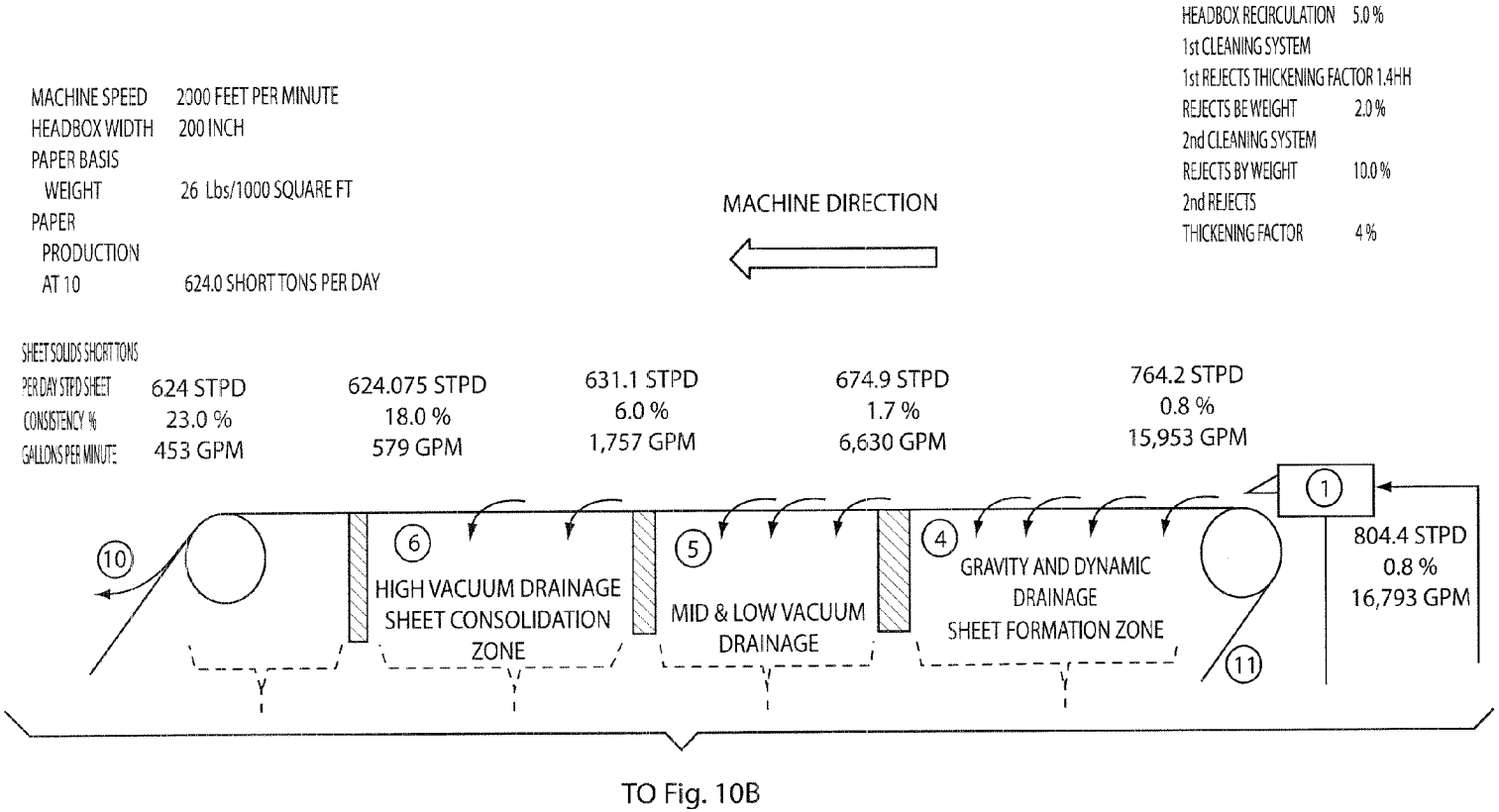
FIG. 10 Depicts mass balance at 0.8% consistency out of headbox.

The forming table of the paper making machine, which is depicted in FIG. 10 in detail, is composed of three main sections, as follows:

A. The gravity and dynamic drainage zone 4, where the sheet formation occurs. At the beginning of the formation zone 4 the fiber consistency is in the range of 0.1 and 1.0%, and at this point the fibers have high degree of freedom and here is where formation can be improved by enhancing the three hydrodynamic processes needed to form a paper sheet. At exit of gravity and dynamic drainage zone 4 the consistency is in the range of 1.5 to 2.0%, and after this zone, the formation can be improved just minimum.

B. The low and mid vacuum zone 5—In this zone with the use of low vacuum boxes, small amount of vacuum is applied, vacuum is in the range of 2 to 60 inches of water, and consistency at exit of zone 5 is in the range of 6 to 8%.

The water drained by zones 4 and 5 is collected in receptacles 25 under the forming and drainage devices, and the water is directed to a storage tank 18 by channels 26 for reuse in stock dilution in the wet end close loop system, as shown in FIG. 8, for example.

C. The high vacuum drainage zone 6, here is where sheet consolidation occurs, water is removed by using high vacuum boxes; vacuum applied is in the range of 2 to 16 inches of mercury. At the end of the wire section the couch 7 removes water with higher vacuum (20 to 22 inches of mercury) assisted by a press roll 8. The water 12 drained in zone 6 is collected in a seal tank 13, the pump 14 sends part of the water for level control 15 in tank 18, the excess water 16 is sent to stock preparation system in conjunction with the overflow water 19 from water storage tank 18.

After the fiber mat is consolidated in the high vacuum drainage zone 6 and press by the suction couch 7 and the lump breaker 8, the sheet 10 leaves the forming table at consistencies between 23 and 27%.

As it was mentioned before, the short loop system at the wet end of the paper machine is the only system that can decrease or increase the consistency at the discharge of the headbox 1.

As an example mass balances are presented, one in FIG. 10 that shows the mass balance at 0.8% consistency out of headbox and another in FIG. 11 that shows the mass balance at 0.5% consistency out of headbox.

It is important to note that in both mass balances the following operating parameters are exactly the same:

| | | |
|---|---|---|
| Headbox recirculation | 5.0% | |
| 1st Cleaning system rejects by weight | 2.0% | |
| 1st Rejects thickening factor | 1.4 | |
| 2nd Cleaning system rejects by weight | 10.0% | |
| 2nd Rejects thickening factor | 4 | |
| Machine Speed | 2000 | Feet per minute |
| Headbox width | 200 | Inch |
| Paper basis weight | 26 | Lbs/1000 Square feet |
| Paper production at 10 out of the forming table | 624.0 | Short Tons per day |

As a result the production 10 out of the forming table is exactly the same in both balances as follows:

| | |
|---|---|
| Sheet solids short tons per day | 624 |
| Sheet Consistency % | 23 |
| Gallons per Minute | 453 |

The sheet formation is better when consistency out of the headbox is at 0.5% than 0.8%, and performance of the equipment is completely different in both cases. The main difference in these two balances is inside the short loop system as follows:

| | Mass balance at 0.8% consistency out of headbox | | | Mass balance at 0.5% consistency out of headbox | | | Increase in mass flow handling due to reduction in consistency from 0.8 to 0.5% at headbox | |
|---|---|---|---|---|---|---|---|---|
| | STPD | % | GPM | STPD | % | GPM | STPD | GPM |
| Headbox 1 discharge | 764.2 | 0.80 | 15,953 | 942.9 | 0.50 | 31,492 | 178.6 | 15,539 |
| Drained water at zone 4 | 89.3 | 0.16 | 9,323 | 268.0 | 0.18 | 24,862 | 178.6 | 15,539 |
| Dilution water to fan pump 24 | 117.9 | 0.16 | 12,578 | 294.7 | 0.18 | 28,111 | 176.8 | 15,533 |

-continued

| | Mass balance at 0.8% consistency out of headbox | | | Mass balance at 0.5% consistency out of headbox | | | Increase in mass flow handling due to reduction in consistency from 0.8 to 0.5% at headbox | |
|---|---|---|---|---|---|---|---|---|
| | STPD | % | GPM | STPD | % | GPM | STPD | GPM |
| Inlet flow to screen 27 | 820.9 | 0.80 | 17,038 | 1012.8 | 0.50 | 33,633 | 191.9 | 16,595 |
| inlet flow to headbox 1 | 804.4 | 0.80 | 16,793 | 992.5 | 0.50 | 33,149 | 188.1 | 16,357 |

STPD Short tons per day
GPM Gallons per minute
% Consistency

By decreasing consistency from 0.8% to 0.5%, the hydraulic flow has been increased by 15,913 GPM as an average, and solids are increased by 183 STPD as an average. In order to move the additional flow it is necessary to increase the power of the motors of the fan pump 24 and the screens 27 and 32, and in many instances it is necessary to change the equipment.

Due to excessive flow when working at low consistency of 0.5%, more chemicals are needed; drainage at zones 4 and 5 becomes more difficult. Performance of the headbox is deteriorated if there is too much turbulence due to an excessive flow; cross currents are created that lead to uneven stock delivery to the sheet forming zone. A headbox which is not functioning properly can cause many defects in the finished sheet. The worst of these is poor formation that results when fibers are not dispersed evenly or uniformly.

By working at 0.8% consistency instead of 0.5%, there is a considerable reduction in the flow to the head box; approximately by 15,913 GPM. As a result there is less steam necessary to keep the slurry at its operating temperature, which means a reduction of 807,946 Btu/min for a 5 degree drop in temperature. It will be noted that with respect to companies that use fuel oil for heating purposes, this could mean a reduction of emission of 4640 tons of carbon dioxide per year to the atmosphere, and with respect to companies that use gas for heating purposes, the reduction of carbon dioxide to the atmosphere is approximately 416 tons per year.

In addition to the above, the excess water 19 sent back to water treatment has less solids (1.8 tons per day less) as can be appreciated from FIGS. 10 and 11.

Figures 12, 12A:
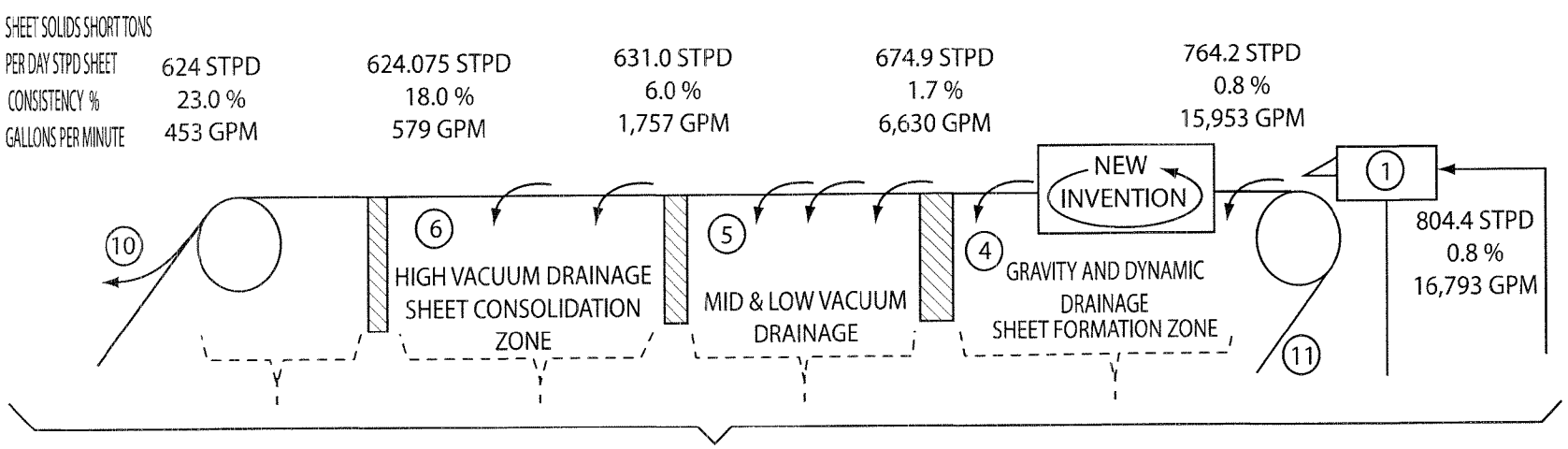
FIG. 12 Depicts the mass balance according to one embodiment of the present invention.
Figure 13:
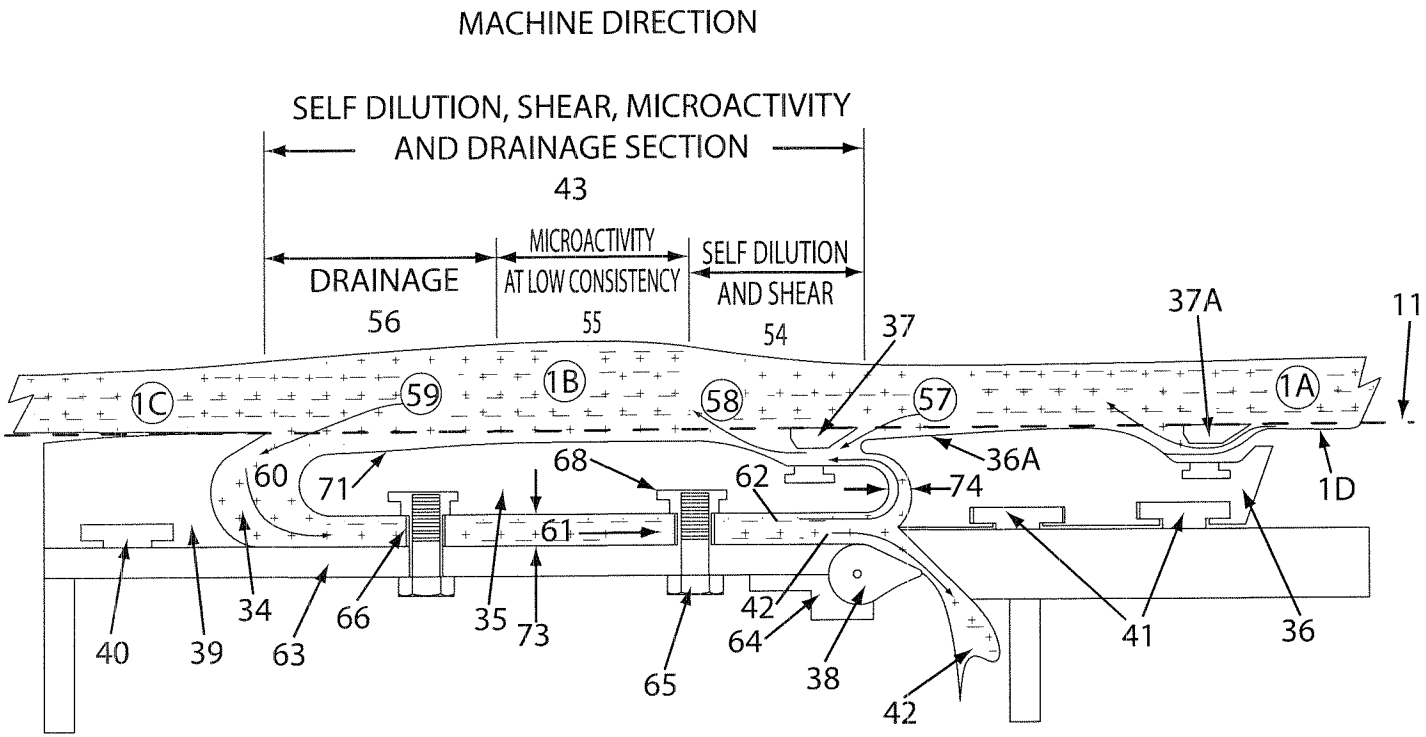
FIG. 13 Depicts the new forming invention.

One aspect of the present invention can be seen in FIGS. 12-19, for example. In FIG. 13, blade 36 has a support blade 37A that has two important functions, one is to maintain the forming fabric separated from the blade 36 in combination with the support blade 37, the other most important function is to allow the previously drained water 1D to pass underneath the support blade 37A. The exit side of the blade 36 has a sloped surface 36A that diverts from the forming fabric 11 in an angle between 0.1 and 10.0 degrees, the drained water from the fiber slurry 1A, will pass under the support blade 37, the drained water 57 will merge with the recirculation water 62, to form a continuous increased flow 58, large part of this flow will be reintroduced to the fiber slurry 1A that will become fiber slurry flow 1B which will have lower consistency than flow 1A. Reduction in consistency is controlled by opening or closing the gate 38 that is held in place by the bottom plate 63 and the support 64. The gate 38 allows to increase or decrease discharged flow 42. By closing or opening the gate 38, flow 62 changes to desired level, as consequence the consistency at 1B may be controlled to produce a uniform mat of fiber on cross machine direction and on machine direction as well. The support blade 37 and the trail blade 39 keep the forming fabric 11 separated from the central plate 35. The gap between the forming fabric 11 and the central plate is always filled with water drained from the fiber slurry 1A, and due to the continuous flow of water, the friction between the central plate 35 and the forming fabric 11 is minimal. At the end of the central plate 35 is located the drainage zone 56, at this point the surface of the central plate 35 slopes away from the forming fabric 11, and the surface 71 with the slope may have anything from 0.1 up to 10 degrees of separation, although it is preferred not to exceed 7 degrees. This kind of geometry recirculates the water 34 from slurry 1B as it is shown in FIG. 13 by the stream lines 59, 60 and 61, in order to be reintroduced by stream 58. The central plate 35 and the bottom plate 63 form a channel 73 wherein both pieces are separated by spacers 66 that allow the drained water 34 scraped by trail blade 39 to move forward to channel 74, at this point the recirculation flow 62 merges with drained flow 57 to form stream flow 58 that will be reintroduced to fiber slurry 1A in order to lower the consistency at 1B at any desired level. It is due to the formation of channel 73 that the merger of two flows at different velocities occurs and high shear effect is produced in section 54. It is important to note, however, that gate 38 controls the amount of purge flow 42. Due to the inherent flow and high shear effect created using the design of the system according to the present invention, it is not necessary to increase the power of the motors of the fan pump 24 or the screens 27 and 32. The instant design, for example, the separation of central plate 35 and the bottom plate 63 to form channel 73 that allows recirculating the instant drained water, results in lower energy consumption when compared to a traditional system.

After drainage zone 56, the consistency of fiber slurry 1C is same as 1A or higher, depending on the amount of water 42 drained by gate 38. The central plate 35 holds the support blade 37, the central plate 35 is in a fixed position in order to maintain the specified distances from the central plate to the forming fabric 11, to the inlet blade 36, to the trail blade 39 and to the bottom plate 63, those distances are designed according to the process needs for specific paper machine, the central plate 35 is fixed by one, two or as many T bars 68 as needed according to the length of the self dilution, shear, microactivity and drainage section. T bars are fixed in position by bolts 65 and spacers 66. The surface 71 of the central plate 35 at drainage section is diverging from the forming fabric 11, and the slope may have anything from 0.1 up to 10 degrees of separation, and pre erred not to exceed 7 degrees.

Figure 20:
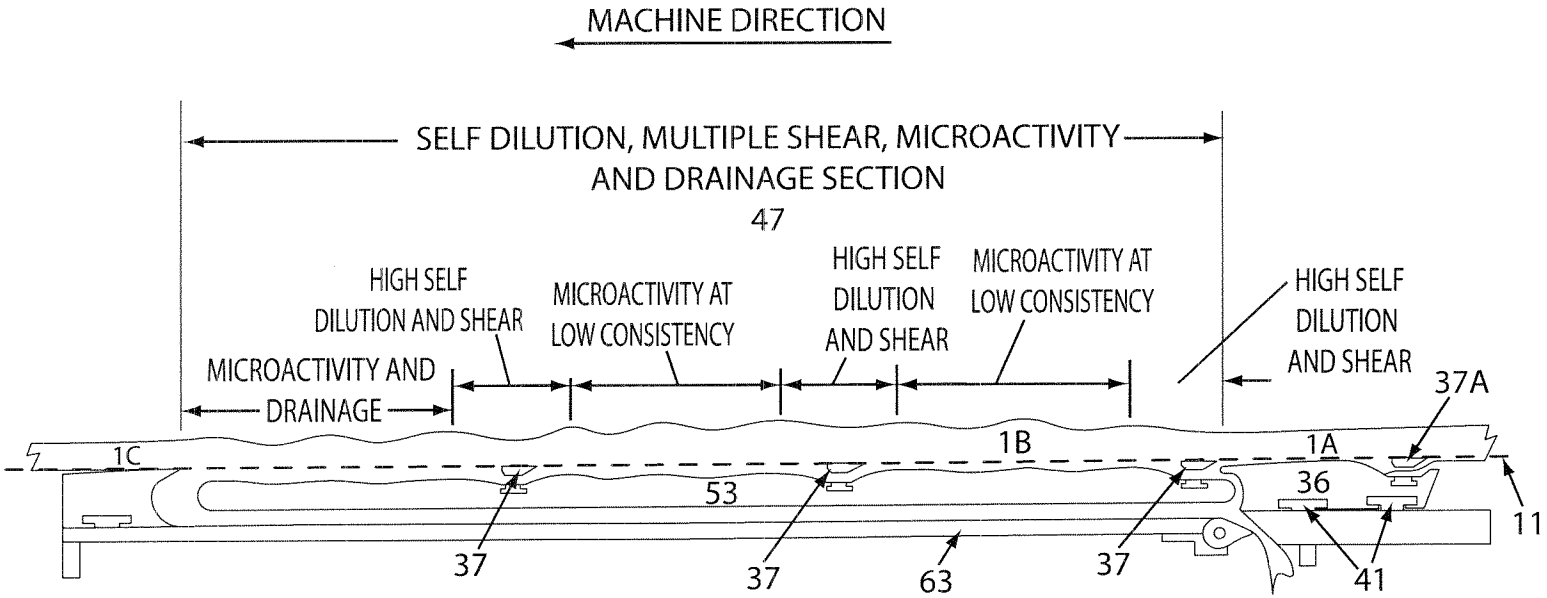
FIG. 20 Depicts another aspect of the new forming invention, which details the geometry of a long self dilution, shear, microactivity and drainage section with multiple converging and diverging sections.

The length of central plate 35 in FIGS. 13, 14, 15, 16, 17, 18, 19 and central plate 53 in FIG. 20 is designed according to the process needs for specific paper machine. Length of central plate will also depend on the machine speed, basis weight and the amount of the consistency reduction needed.

Figure 21:
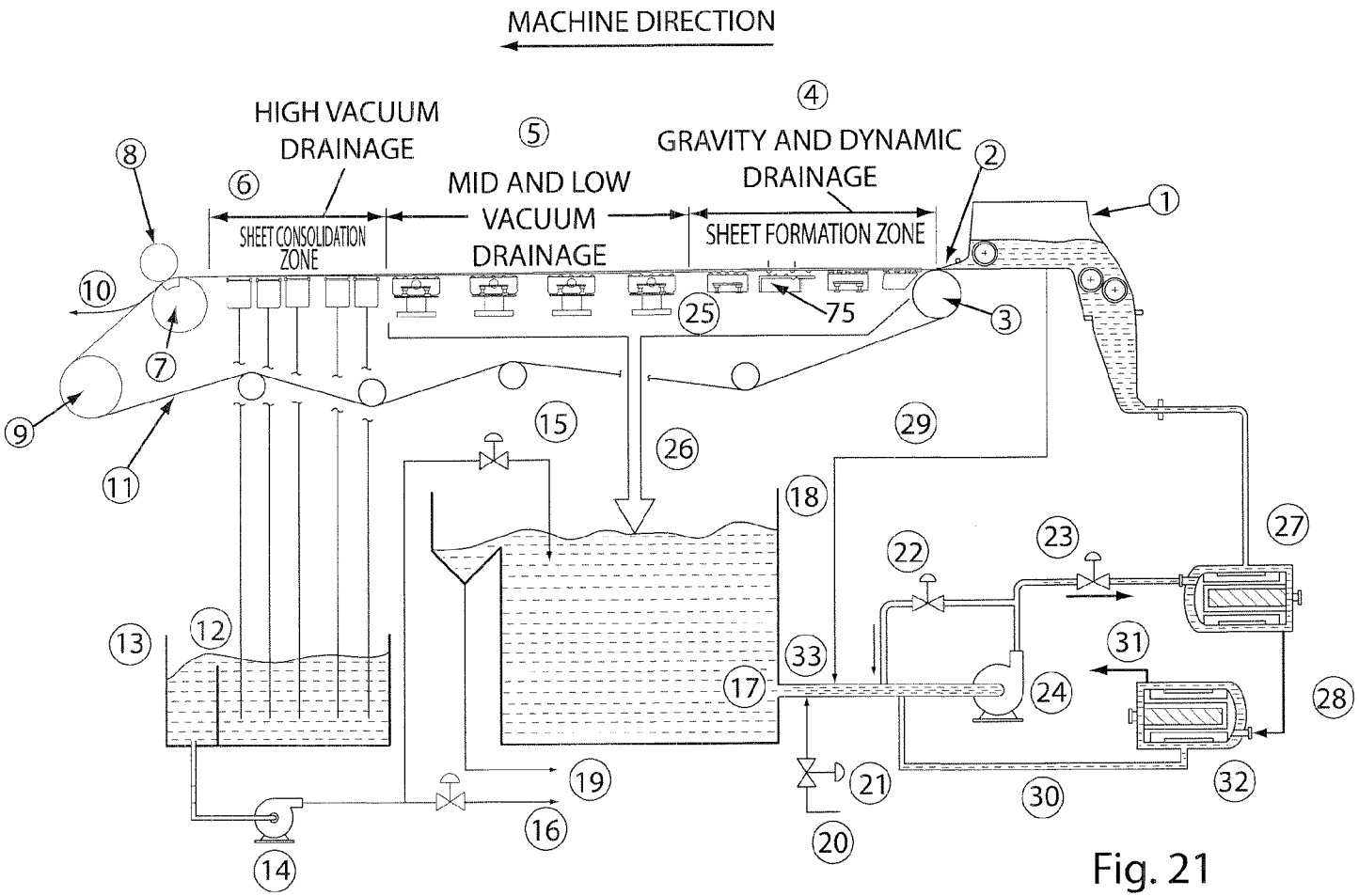
FIG. 21 Flow sheet that depicts the location of the new invention 75 at the wet end of a paper machine with the new invention as it is described in FIG. 13.
Figure 22:
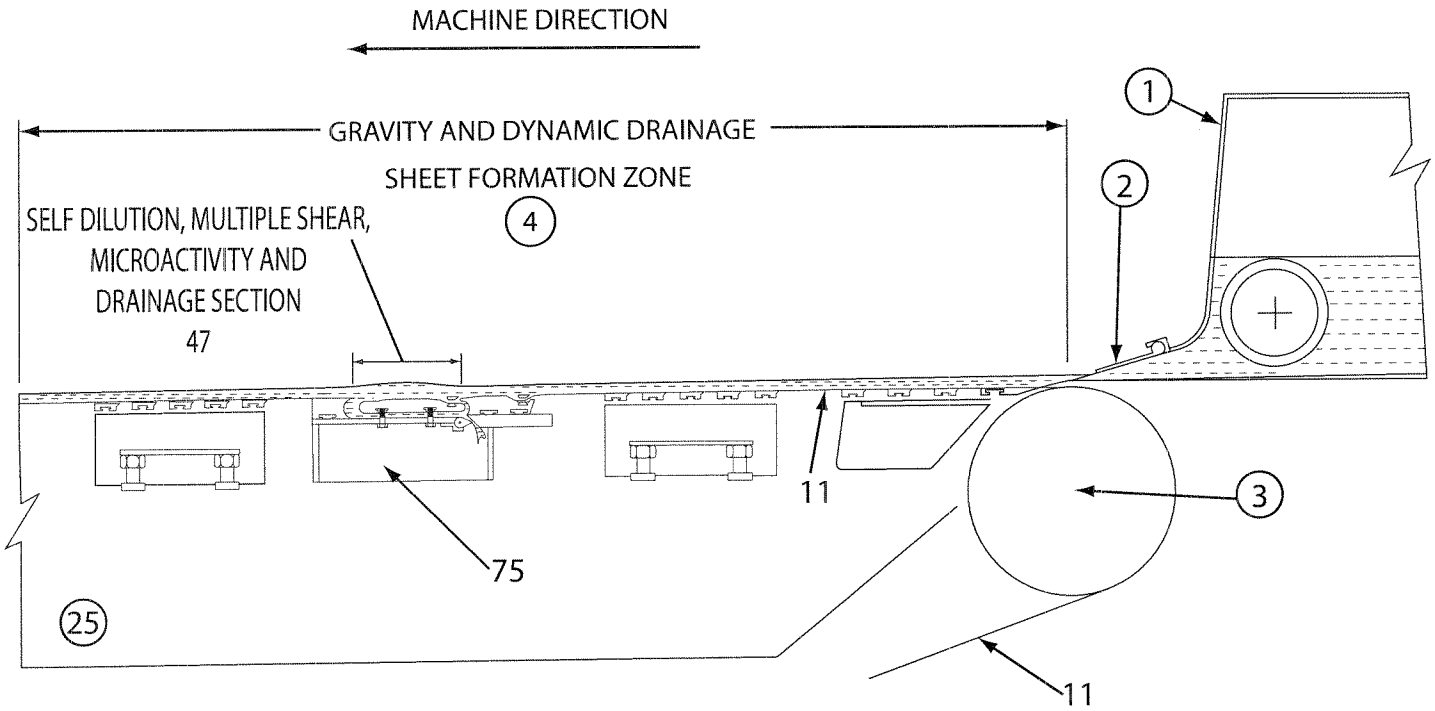
FIG. 22 Flow sheet that depicts the location in detail of the new invention 75 at the wet end of a paper machine as it is described in FIG. 13.

FIG. 21 shows location of the new invention 75 at the gravity and dynamic drainage in the sheet formation zone 4; FIG. 22 shows detailed location of the new invention 75 at the gravity and dynamic drainage in the sheet formation zone 4.

Figure 23:
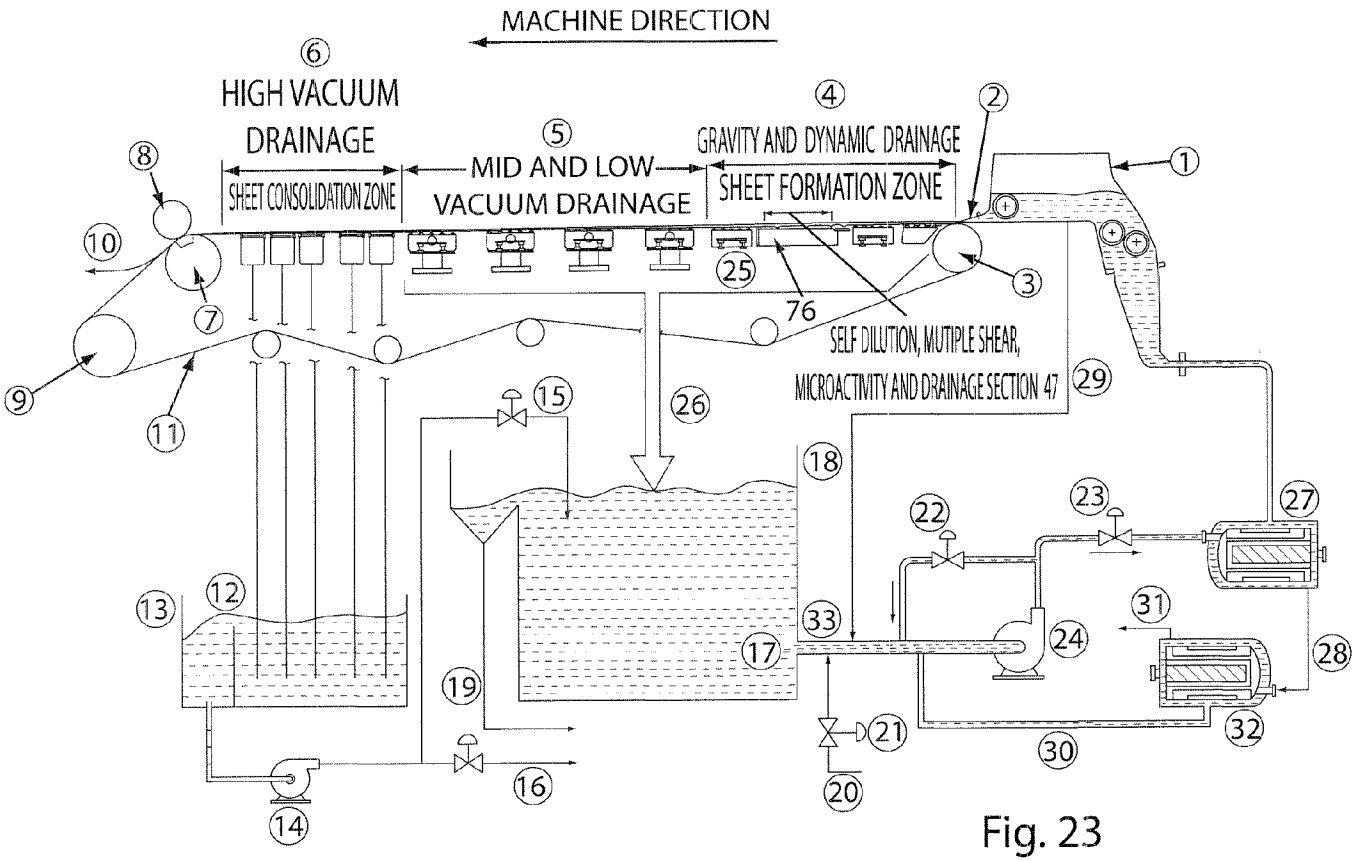
FIG. 23 Flow sheet that depicts the location of the new invention 76 at the wet end of a paper machine with the new invention as it is described in FIG. 20.
Figure 24:
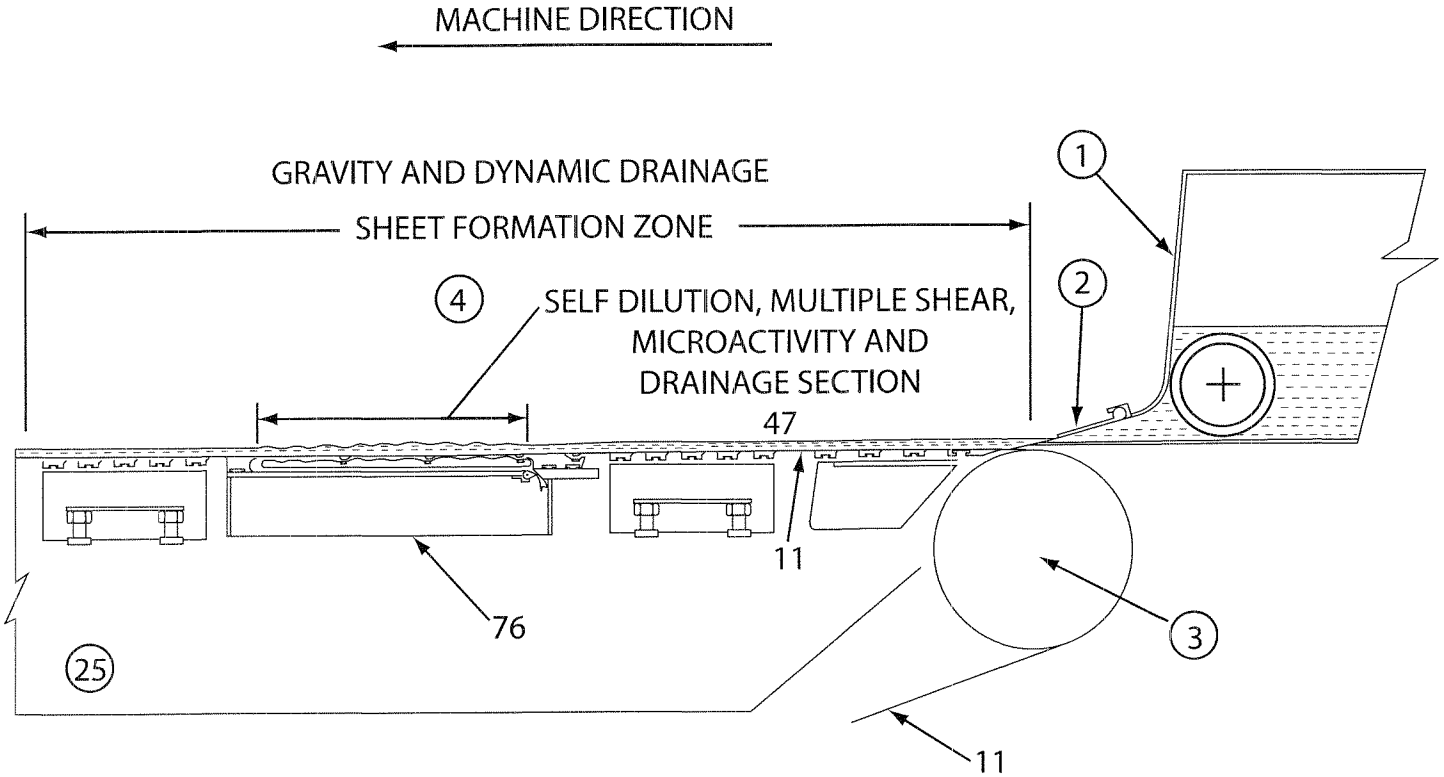
FIG. 24 Flow sheet that depicts the location in detail of the new invention 76 at the wet end of a paper machine, as it is described in FIG. 20.

FIG. 23 shows the location of the new invention 76 at the gravity and dynamic drainage in the sheet formation zone 4; FIG. 24 shows detail location of the new invention 76 at the gravity and dynamic drainage in the sheet formation zone 4.

The new invention installed at gravity and dynamic drainage in the sheet formation zone 4 erases the necessity of lowering the fiber slurry consistency at the head box, and as a result will give same benefits as working with traditional system (lower the consistency in whole system).

As an example of benefits obtained with new invention in sheet formation physical properties and productivity when the paper machine is working with low consistency are in mass balance in FIG. 12. Said benefits may be obtained by working with the new invention installed as per FIGS. 21, 22, 23 and 24, instead of traditional system.

A mass balance with the new invention is presented in FIG. 12; benefits of working with the new invention are as follows:

I. Lower energy consumption when working with the new invention than working with traditional system.

II. There is no need to change the actual equipment for a large one such as machinery and or piping.

III. Lower emissions into the atmosphere because of less steam or fuel necessary to heat the fiber slurry.

IV. More environmental friendly because less solids are sent to the water treatment unit.

V. Fewer solids in the water system.

VI. Less use of chemicals.

VII. Better paper quality when working with the new invention than working with traditional system because the new invention in addition to reducing the consistency also produces at the same time the three hydrodynamic processes needed to make paper.

VIII. The design operating velocities inside of machinery such as headbox 1, screens 27 and 32 are always inside the design limits when operation is made with the new invention, because the design flows are not exceeded.

IX. Fiber lost is less with the new invention.

X. Recirculates the same drainage water right after leaving the forming fabric not even leaving the forming table.

XI. There is no fiber contamination from other sources; this benefit makes the process more stable.

XII. There is not temperature change in the forming section 4.

XIII. There is no air entrapped in the system.

XIV. There is no change in retention.

XV. A change paper grade is easy because the volume inside the new invention is a small amount.

XVI. It is a continuous recirculation plug flow.

Figure 30:
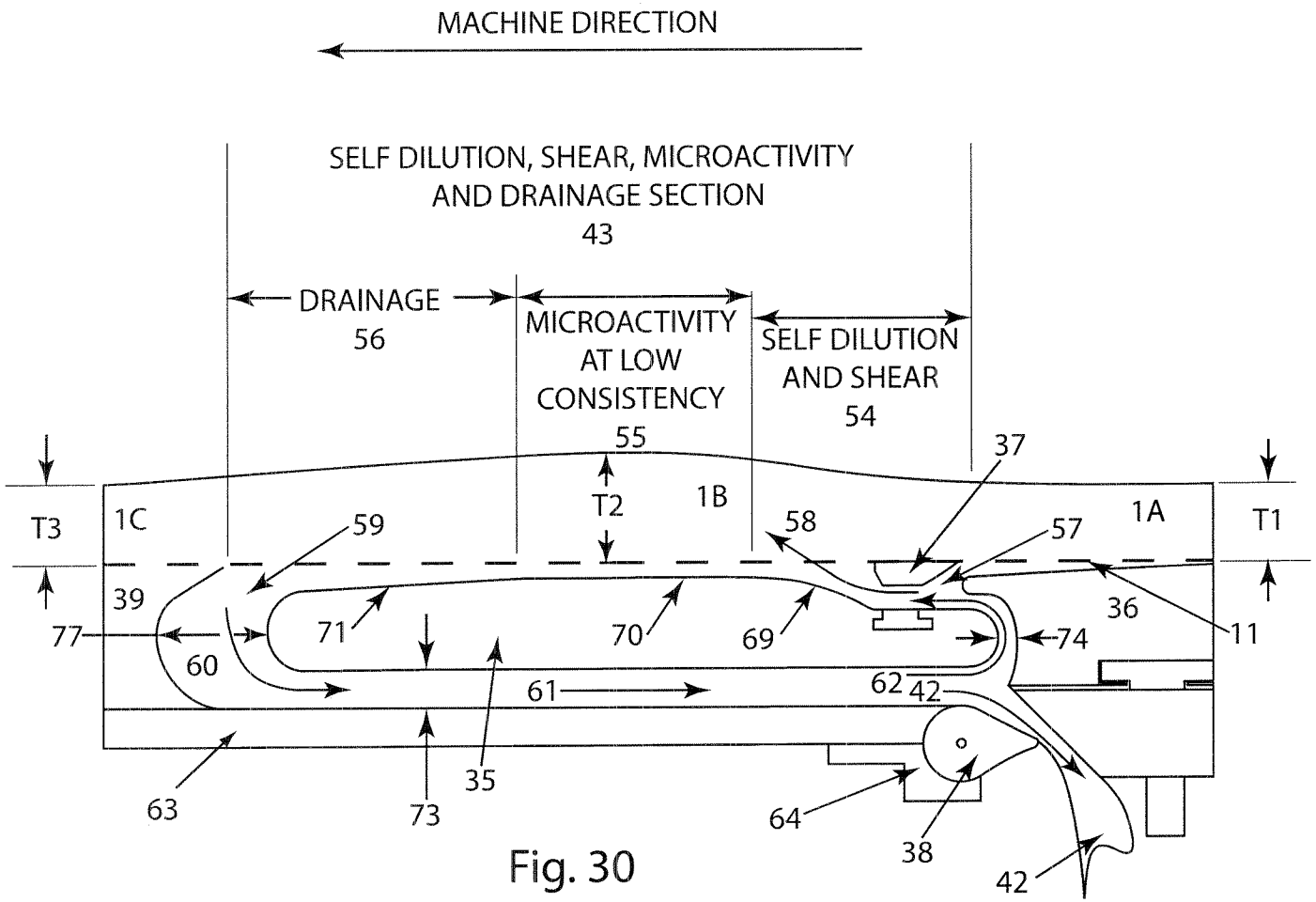
FIG. 30 Depicts another aspect of the new forming invention, with detail explanation of the hydraulics at the self dilution, shear, microactivity and drainage section including explanation of stream lines.

XVII. Radial design of surface 69 evens the flow 58 reducing the fiber mat variability on cross machine direction as it is shown in FIG. 30.

XVIII. There is no filtration process in the early part of the blade.

XIX. The power to drive the wire is reduced because friction between the wire and the blade is minimum, and total flow on top of the forming table is reduced.

XX. There is no dirt accumulation on the blade because there is continuous flow of water.

XXI. The fibers on the wire are redistributed and activated with the same water.

XXII. Fiber retention is increased.

XXIII. Formation is improved.

XXIV. Squareness of the sheet is controlled as is necessary.

XXV. Drainage is also controlled.

XXVI. Fibers are evenly distributed across the thickness of the sheet.

XXVII. Physical properties of the paper are improved or controlled as they are necessary.

Figure 25:
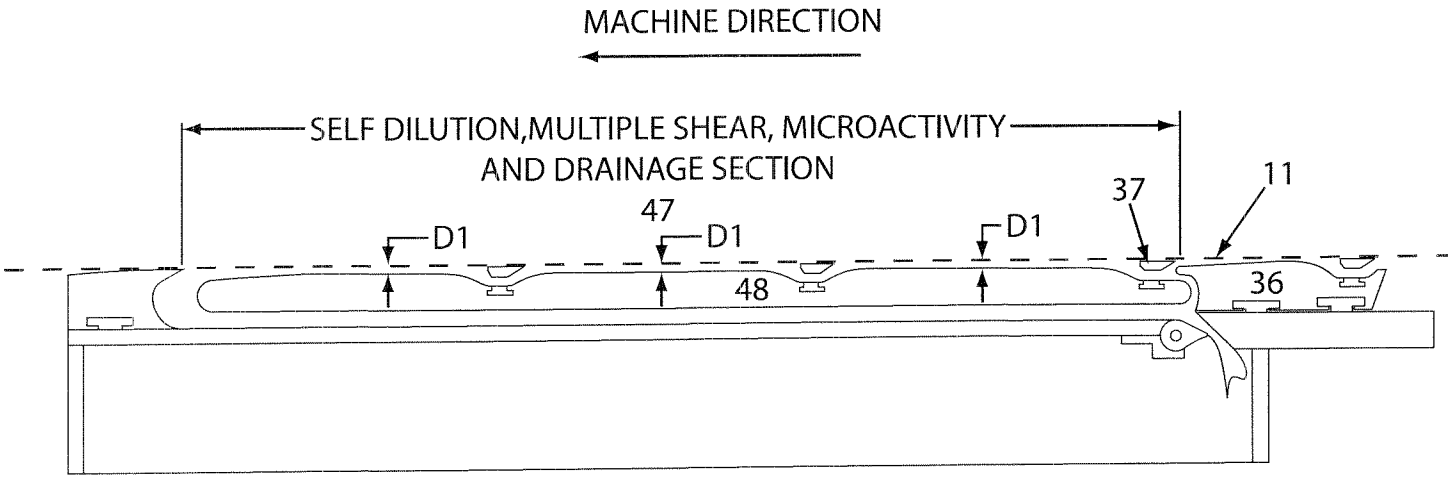
FIG. 25 Depicts another aspect of the new forming invention, details the blade geometry of the long self dilution, shear, microactivity and drainage sections with same distance between the forming fabric and the surface of the central plate 48 with multiple forming fabric supports.

FIG. 25 presents the new invention with the self dilution, multiple shear, microactivity and drainage section, having a constant gap D1 between the forming fabric 11 and the central plate 48.

Figure 26:
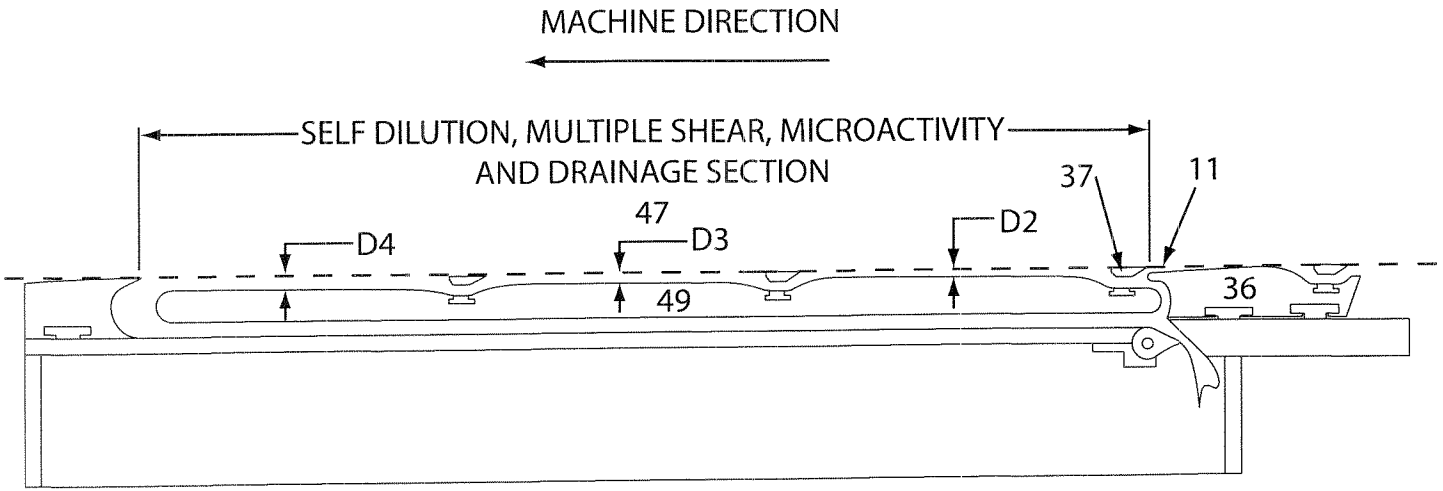
FIG. 26 Depicts another aspect of the new forming invention, details the central plate geometry with multiples self dilution, shear, microactivity and drainage sections increasing the distance between the forming fabric and the surface of the central plate 49 with multiple forming fabric supports.

FIG. 26 presents the new invention with the self dilution, multiple shear, microactivity and drainage section, having an increasing gap D2, D3 and D4 between the forming fabric 11 and the central plate 49.

Figure 27:
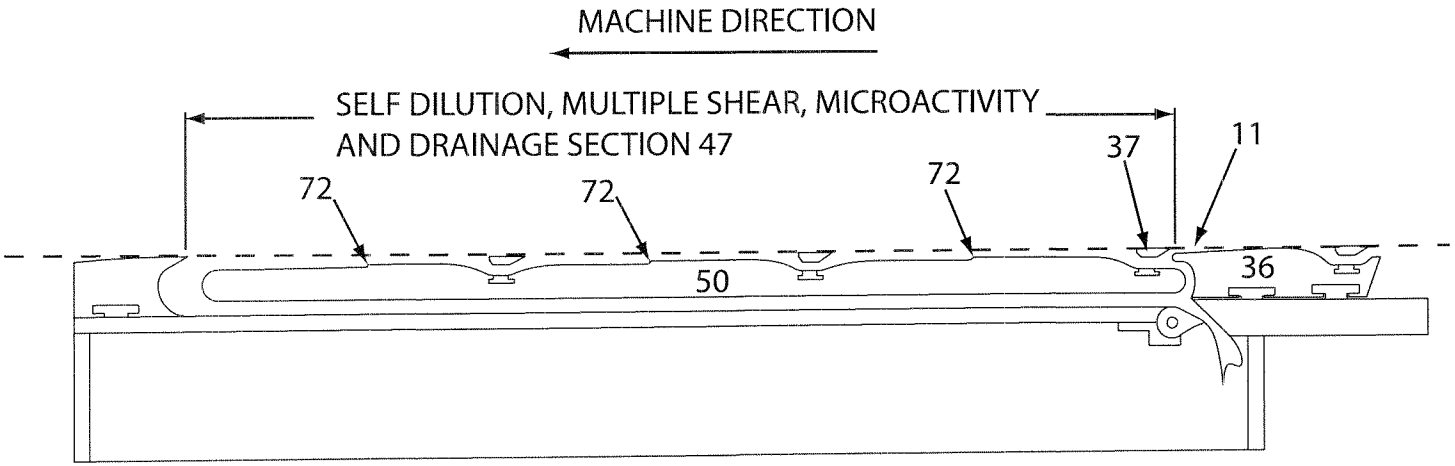
FIG. 27 Depicts another aspect of the new forming invention, details the central plate with multiples self dilution, shear, microactivity and drainage sections with offset plane surfaces between the forming fabric and the surface of the central plate with multiple forming fabric supports.

FIG. 27 presents the new invention with the self dilution, multiple shear, microactivity and drainage section, having an offset plane surface 72 between the forming fabric 11 and the central plate 50.

Figure 28:
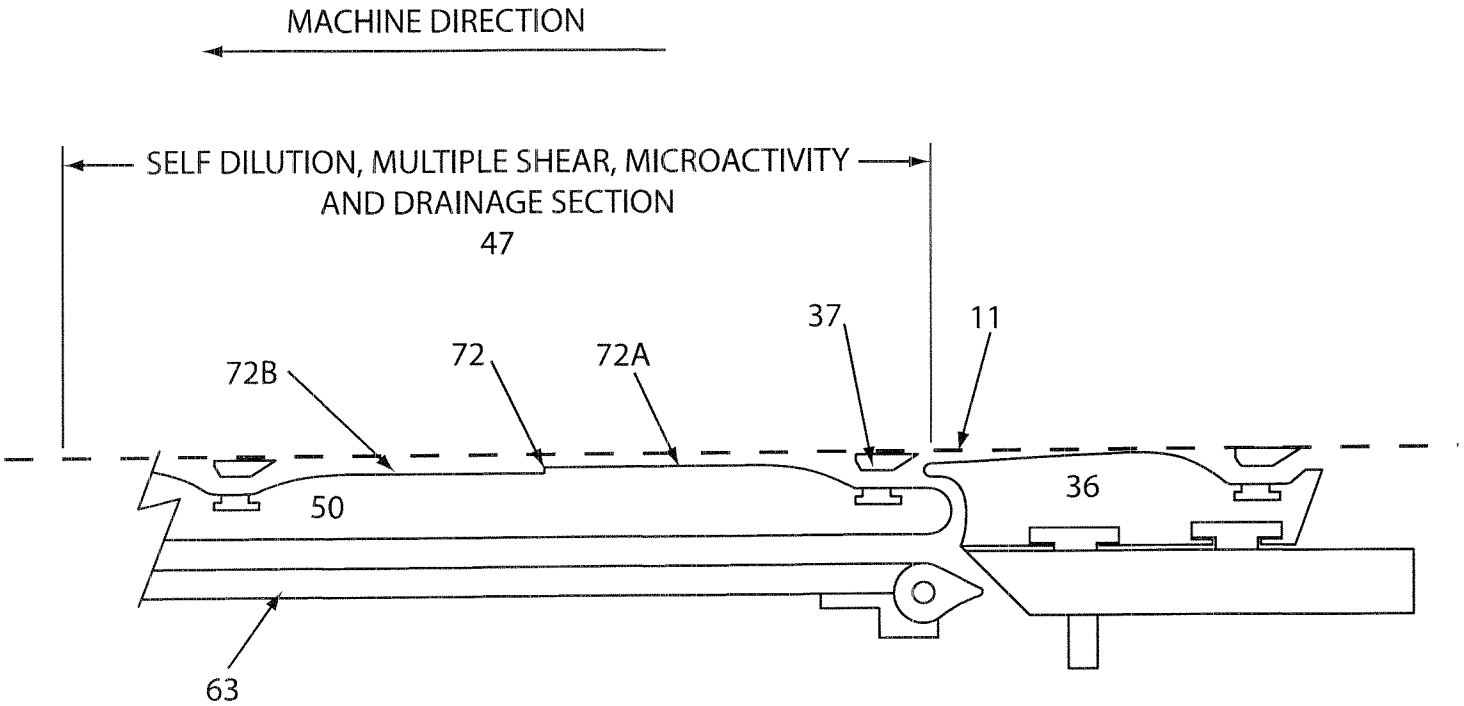
FIG. 28 Depicts another aspect of the new forming invention, which details the geometry of the offset plane section on the self dilution, shear, microactivity and drainage sections.

FIG. 28 presents the new invention with the self dilution, multiple shear, microactivity and drainage section, with detail description the offset plane surfaces between the forming fabric 11 and the central plate 50, surface 72A is offset of surface 72B by step 72, and the hydrodynamic action observed here was described in FIBER MAT FORMING APPARATUS AND METHOD OF PRESERVING THE HYDRODYNAMIC PROCESSES NEEDED TO FORM A PAPER SHEET by Cabrera, Patent Application Publication No.: US 2009/0301677 A1.

Figure 29:
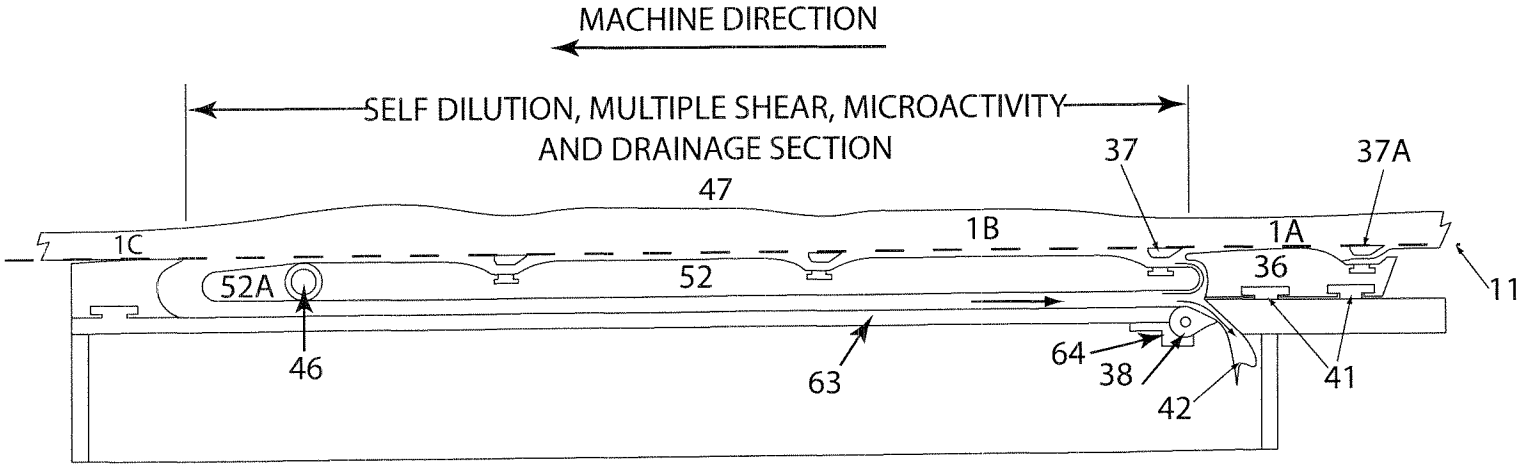
FIG. 29 Depicts another aspect of the new forming invention, with details view geometry of the long self dilution, shear, microactivity and drainage section with pivot point at the drainage section.

FIG. 29 presents the new invention with the self dilution, multiple shear, microactivity and drainage section, having a pivot point at drainage area of the central plate 52 in order to control the activity and amount of water to be drained. The pivot point allows section 52A to be adjusted as the process needs.

FIG. 30 presents the new invention with the self dilution, multiple shear, microactivity and drainage section with detail explanation of different sections as follows:

A. Self Dilution and Shear Section 54:

This section begins at leading edge of support 37 and ends at end of radial section 69. The length of this section depends on the machine speed, and the amount of water 58 to be introduced to the fiber slurry 1A. Stream flow 58 is composed by streams flows 57 and 62, and stream flow 62 follows the path of channel 74 which allows to have a continuous and uniform flow that later will merge with flow 57 and be delivered into the forming fabric 11 to become flow 1B. The amount of stream flow 62 is controlled by the amount of water 42 purged through gate 38.

High shear effect is developed in this section by controlling differential velocities between flows 1A and flow 58, after these flows merge, high dilution in flow 1A takes place and microactivity is initiated. The radial design of surface 69 evens the flow 58, reducing the fiber mat variability in cross machine direction.

Length of self dilution and shear section depends on machine speed, basis weight and consistency decrease.

B. Microactivity at Low Consistency 55:

Surface 70 of central plate 35 may have different configuration as was described early in this document, and also in FIBER MAT FORMING APPARATUS AND METHOD OF PRESERVING THE HYDRODYNAMIC PROCESSES NEEDED TO FORM A PAPER SHEET by Cabrera, Patent Application Publication No.: US 2009/0301677 A1. There is a gap between the surface 70 of the central plate 35 and the wire 11, this feature allows having water in between them provoking microactivity and shear effect, at this section is where the lowest consistency is obtained.

Length of microactivity at low consistency section will depend on machine speed, basis weight and type of fiber.

Figure 31:
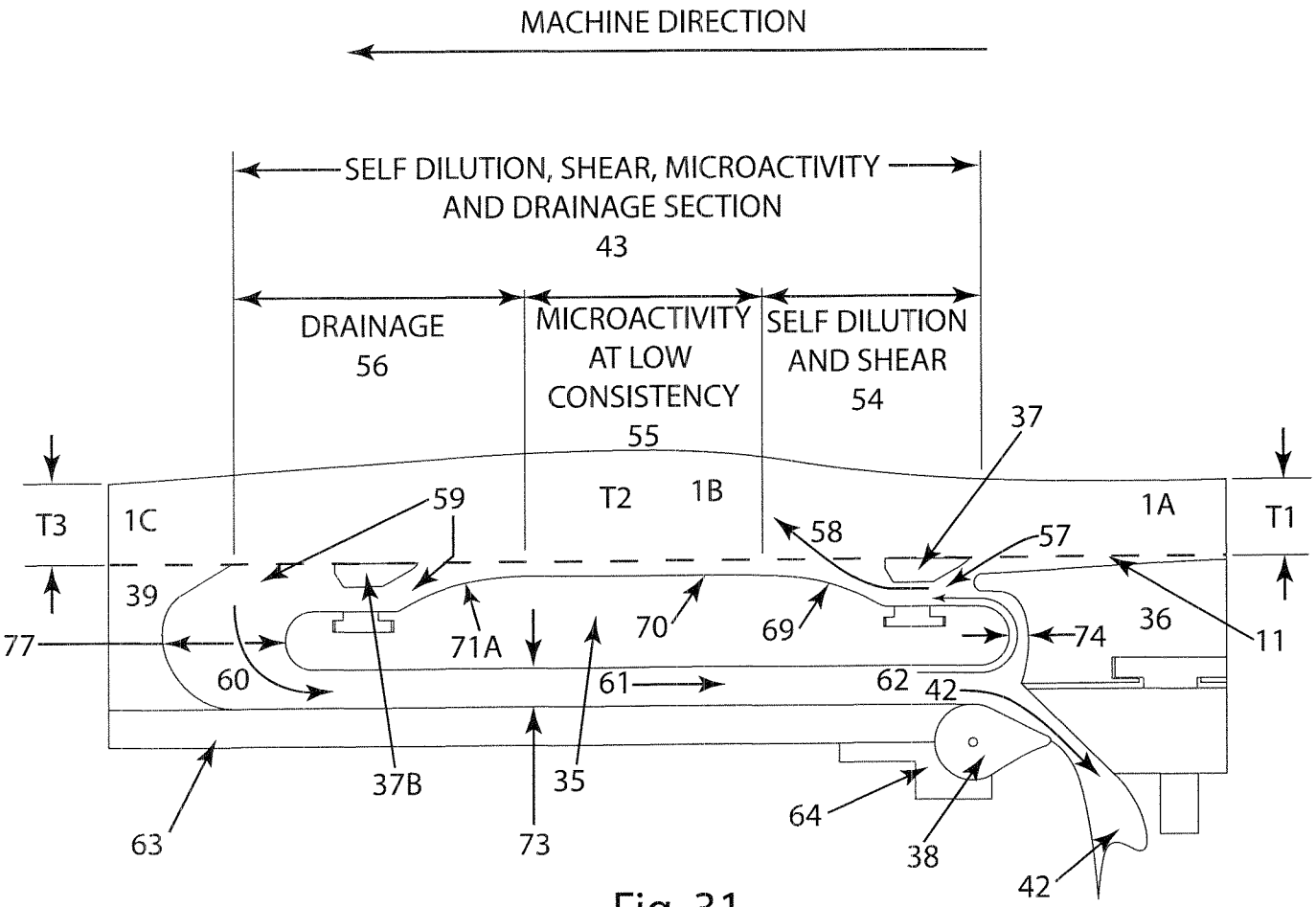
FIG. 31 Depicts another aspect of the new forming invention, with detail explanation of the hydraulics at the self dilution, shear, microactivity and drainage section including explanation of stream lines with two blade supports in order to reduce wire deflection.

C. Drainage 56:

Stream flow 59 in FIGS. 30 and 31 occur in last section of central plate 35. The surface 71 of the central plate 35 at drainage section is diverging from the forming fabric 11. The slope may have anything from 0.1 up to 10 degrees of separation, preferably not to exceed 7 degrees. Length of drainage section will depend on the amount of flow to be drained. The flow 59 continues to flow 60 through channel 77 that is located in between last part of central plate and trail blade 39. Channel 77 is designed in order to avoid fiber stapling and to have minimum friction losses, stream flow continues through channel 73.

In case that wire 11 deflects and contacts the central plate, second support blade 37B is added, as it is shown in FIG. 31. At end of surface 70 of central plate 35 a radial surface 71A follows in continuation in order to maintain stream flow 59 in continuous contact with central plate 35 (avoid flow separation).

Figure 32:
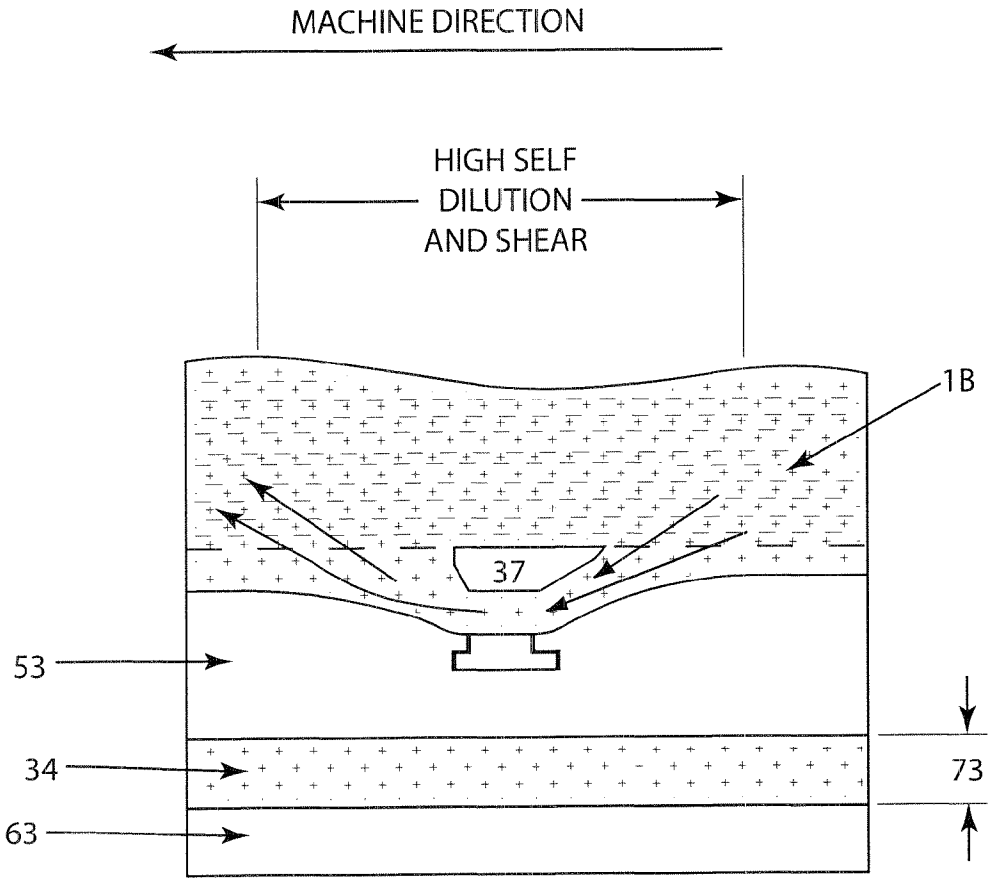
FIG. 32 Depicts another aspect of the new forming invention, with detail explanation of the hydraulics at the self dilution and shear section.

FIG. 32 presents detail explanation of the hydraulics at the self dilution and shear section of the new invention. Support blade 37 prevents the wire from deflecting and coming in contact with central plate 53, the stream flow drained from fiber slurry 1B passes underneath the support blade and later is reintroduced to the fiber slurry were shear effect takes place.

Figure 33:
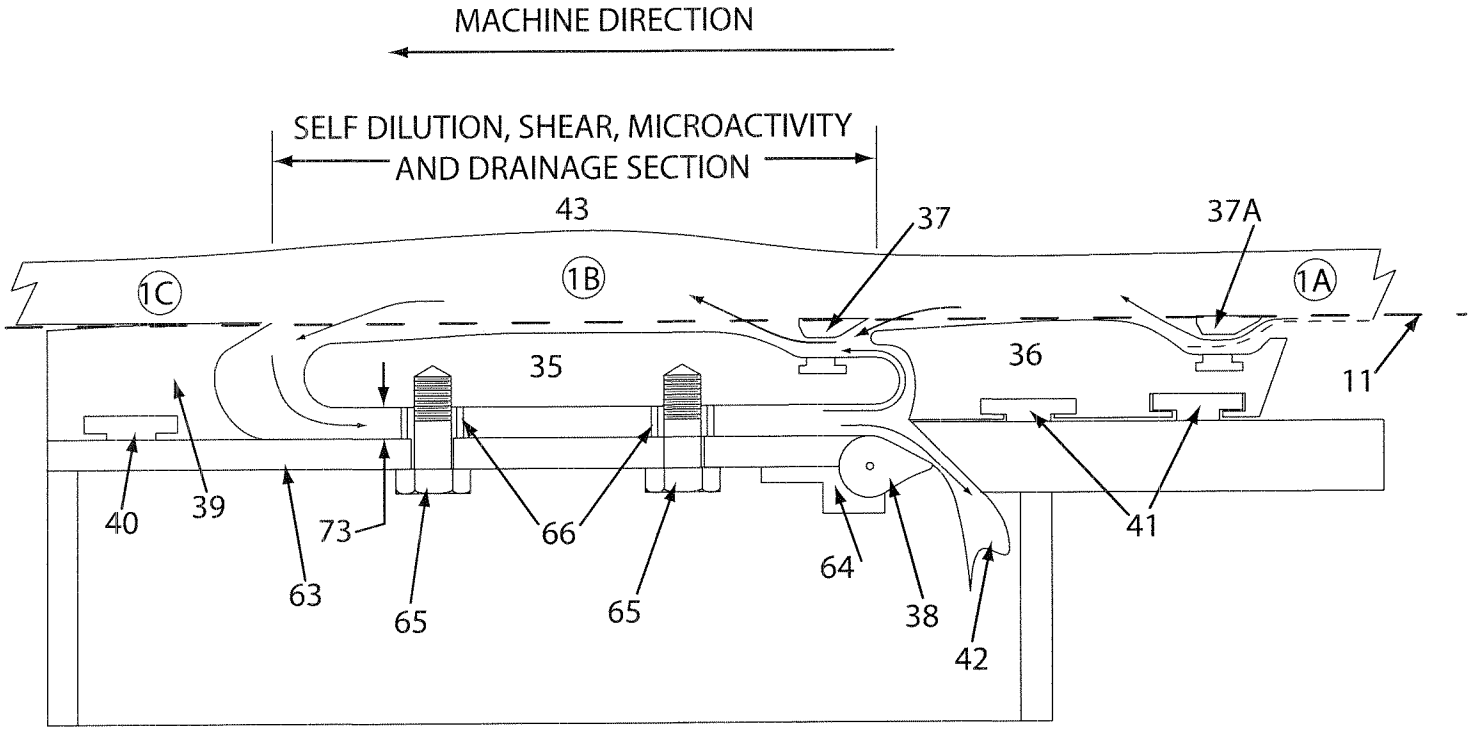
FIG. 33 Depicts another aspect of the new forming invention, shows detailed geometry of one system for holding the central plate.

FIG. 33 presents detail explanation of the geometry that holds the central plate 35. Bolts 65 and spacers 66, for example, may be used between bottom plate 63 and central plate 35 to help form channel 73.

Figure 34:
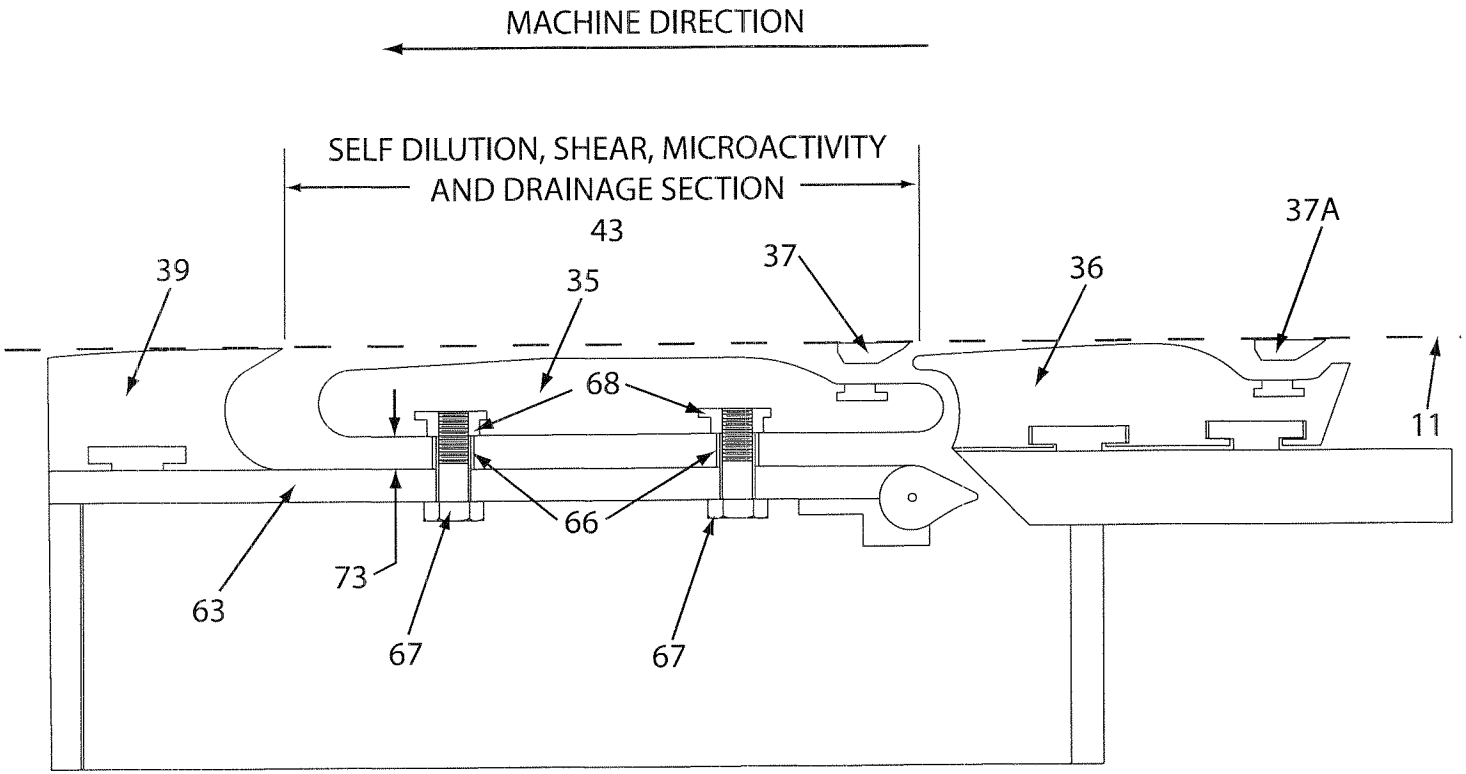
FIG. 34 Depicts another aspect of the new forming invention, shows details geometry of another system for holding the central plate.

In an alternative embodiment as shown in FIG. 34, for example, T bars 68 and spacers 66 may be used between bottom plate 63 and central plate 35 to hold the central plate 35 and form channel 73.

Figure 35:
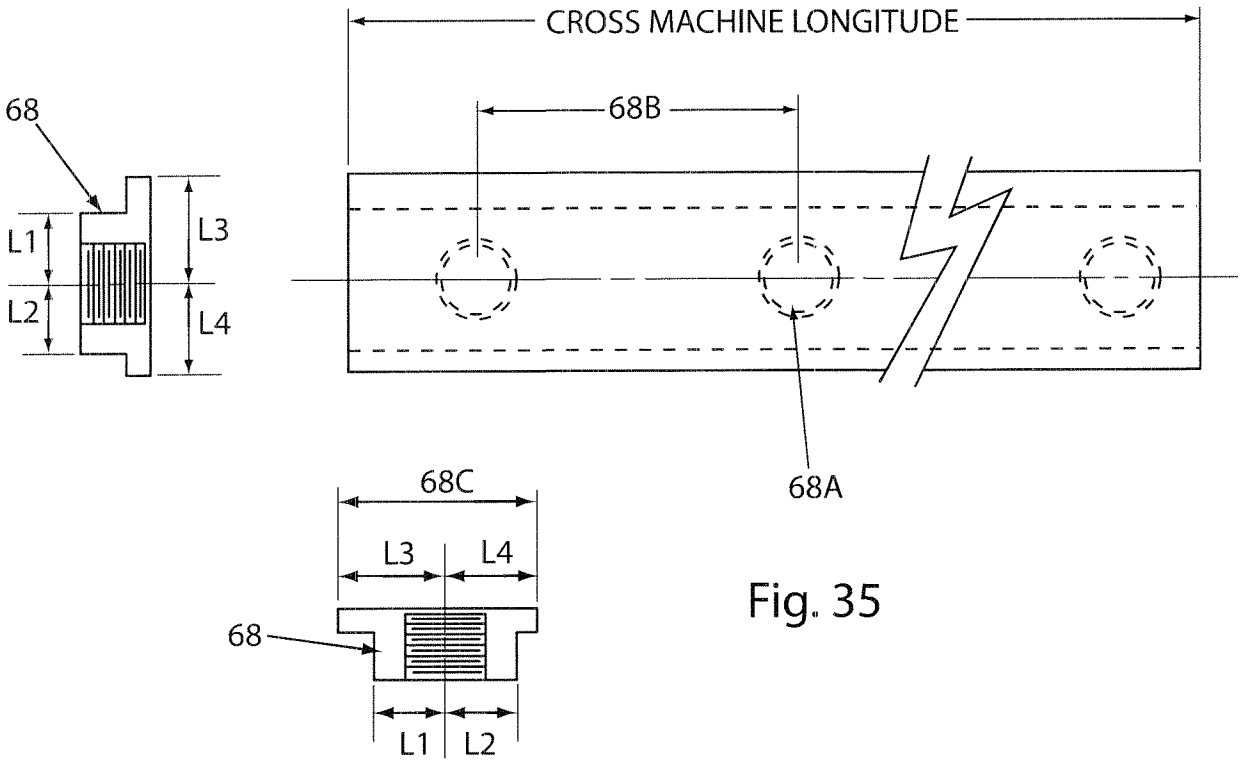
FIG. 35 Depicts details geometry of the T bar used to hold the central plate 35 and or any blade.

FIG. 35 presents detail explanation of the T bar 68 geometry. Distance 68B between Tap holes 68A varies between 4 and 10 inches, and it is specifically designed for each paper machine. Distance L1 and L2 are equal, this section is the portion that connects directly with spacers 66 or the main structure of the box. Distance L3 and L4 are different from each other, in this case L3 is larger than L4 but can be the other way around without losing the principle. The head of the T bar 68C is the part that connects directly with the central plate 35 in this case or may be with any blade, due to difference in distance L3 and L4 the central plate 35 and or any blade will slide in only in one direction.

Figure 36:
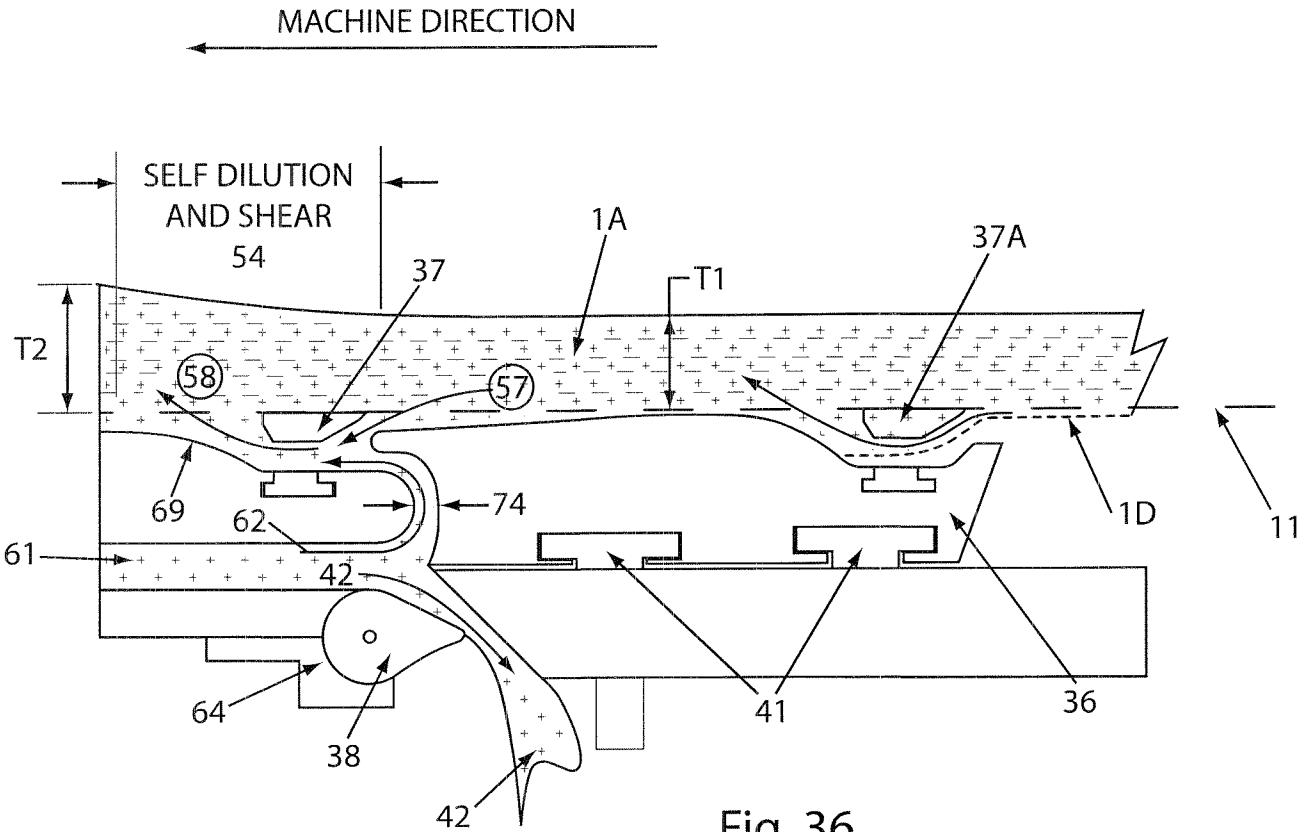
FIG. 36 Depicts the hydraulic performance at self dilution and shear zone 54 of the new invention.
Figure 37:
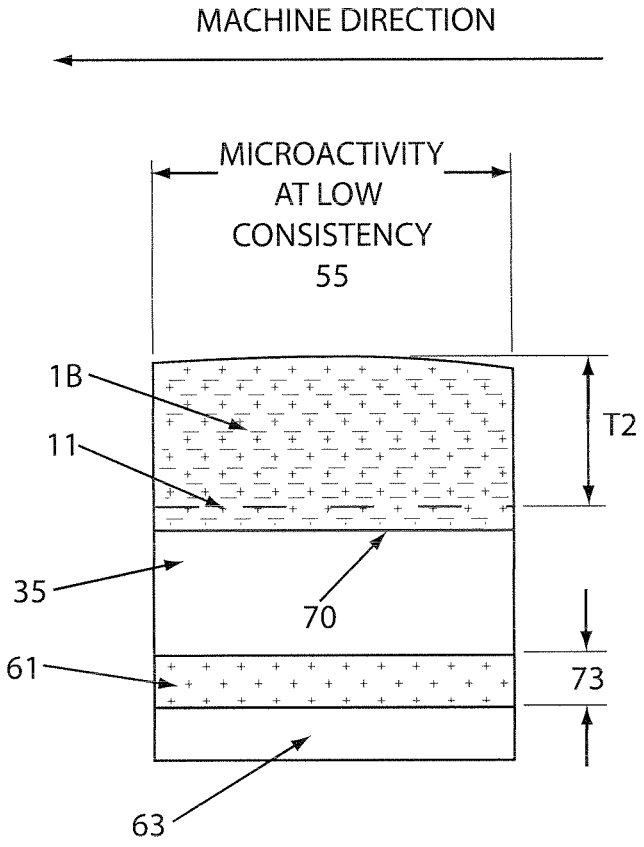
FIG. 37 Depicts the hydraulic performance at low consistency microactivity zone 55 of the new invention.

FIGS. 36, 37, 38 and 39 presents detail explanation of the hydraulic performance of the new invention. FIG. 36, the effect created by blade 36 and support blade 37A was explained in FIBER MAT FORMING APPARATUS AND METHOD OF PRESERVING THE HYDRODYNAMIC PROCESSES NEEDED TO FORM A PAPER SHEET by Cabrera, Patent Application Publication No.: US 2009/0301677 A1, the entire contents of which is incorporated herein by reference. The stream flow 57 merges with stream flow 62 flowing underneath support blade 37 in order to be reintroduced 58 to fiber slurry 1A, in section 54 high shear effect is produced, caused by the merger of two flows at different velocities, it is important to note gate 38 controls the amount of purge flow 42.

Figure 38:
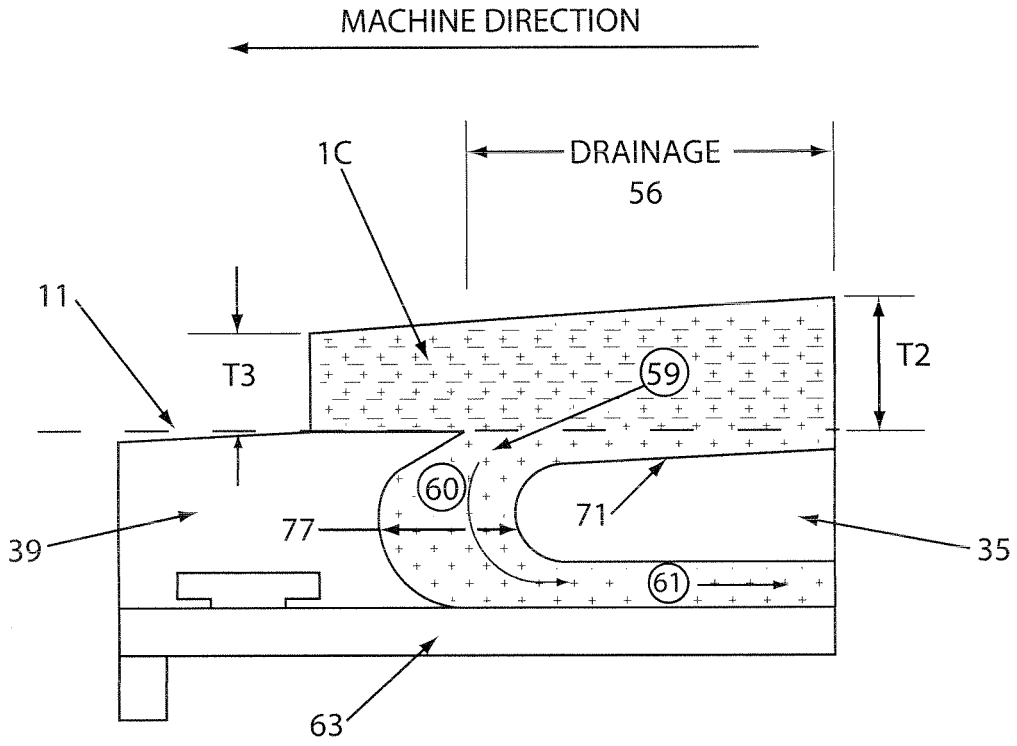
FIG. 38 Depicts the hydraulic performance at drainage zone 56 of the new invention.
Figure 39:
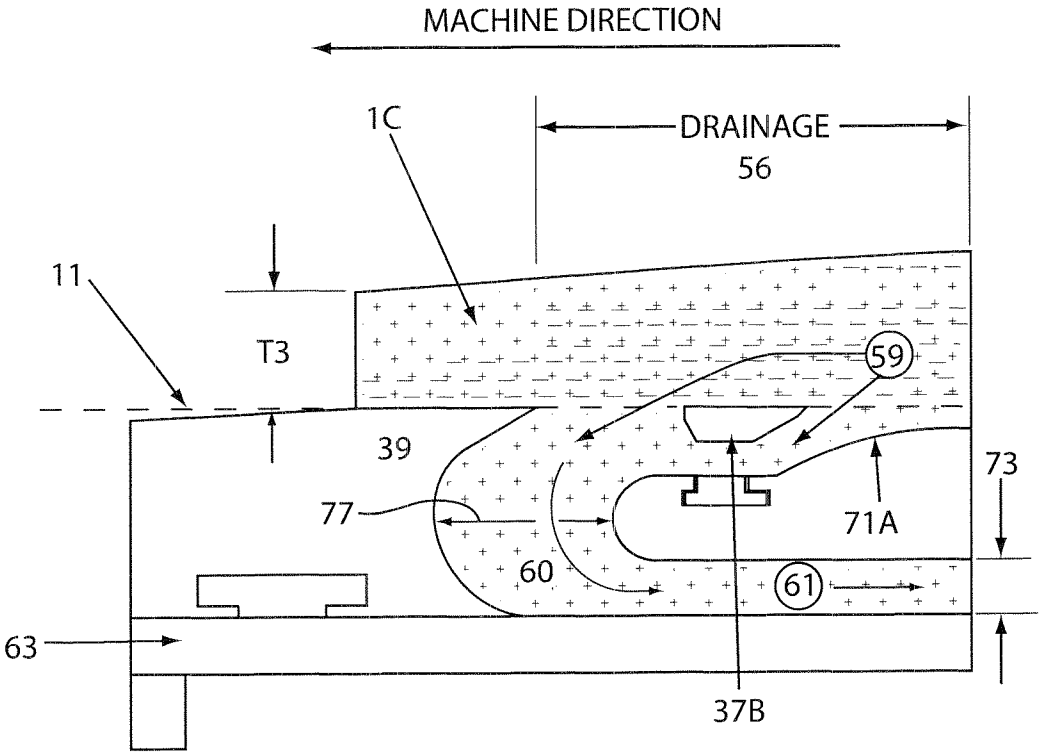
FIG. 39 Depicts another design of the hydraulic performance at drainage zone 56 of the new invention.

FIGS. 38 and 39 presents detail explanation of drainage process, where surface 71 slopes away from the forming fabric 11, the slope may have anything from 0.1 up to 10 degrees of separation, but preferably not to exceed 7 degrees. This kind of geometry produces vacuum due to the loss of potential energy, and drained water follows path of stream lines 60 and 61. In case distance from support blade 37 and trail blade 39 is large and the forming fabric 11 touches the central plate 35, additional support blade 37B may be installed, radial surface 71A is installed in order to avoid flow 59 separation from central plate 35, flow continues through channels 77 and later on channel 73.

Chemical Addition

In another embodiment, paper making chemicals as known to those of ordinary skill in the art are added to fiber suspension in order to enhance paper strength and machine productivity. All paper chemicals are added before or after the forming table.

The efficiency of the chemicals is greatly reduced when added before the forming table because of the large dilution and high volume water recirculation at the forming section, in addition to the above, the response time to any change in chemical dosage is not immediate.

When chemicals are added after the forming table, normally is done at the size press in this case the speed of the paper machine is reduced between 13 to 25% or it is necessary to add more dryers in order to evaporate the additional water in the paper web, in both situations there is more use of energy.

Each grade of paper requires a specific combination of furnish ingredients which are selected according to the specifications of the paper being produced.

Figure 13A:
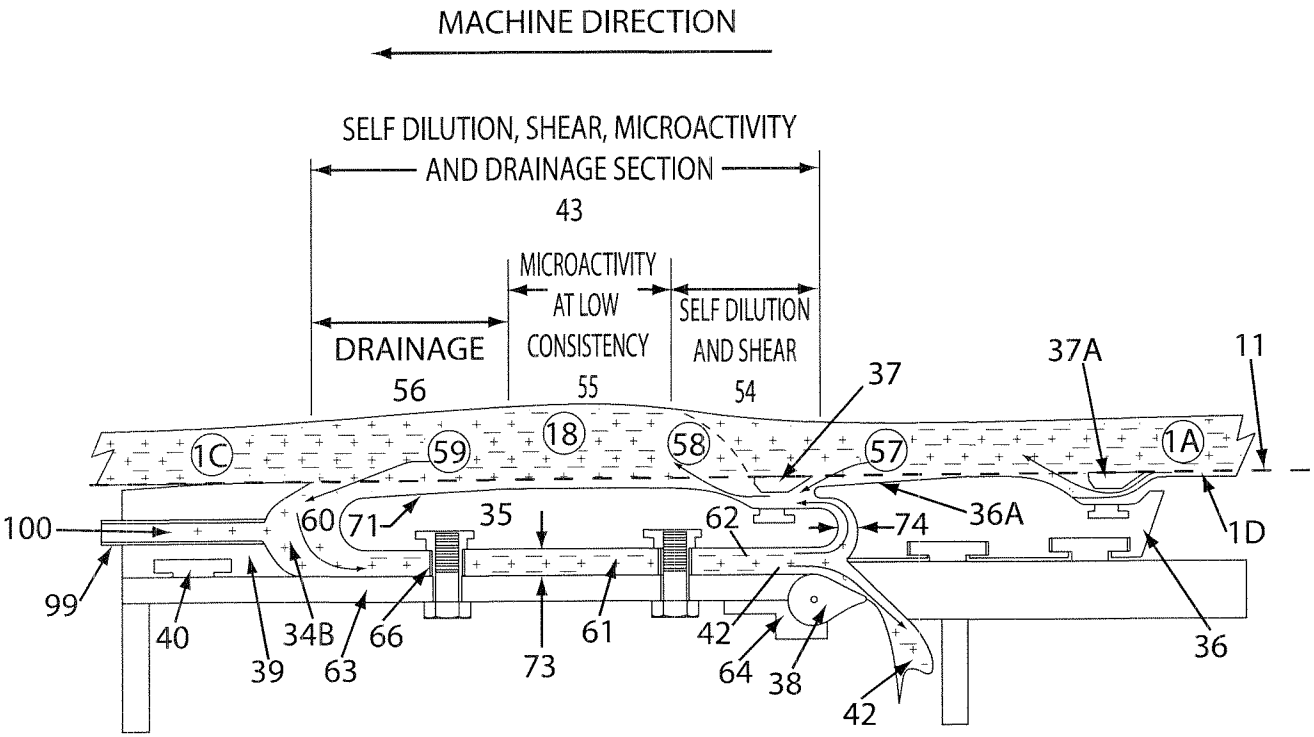
FIG. 13A Depicts the new forming invention showing the chemical injection.

As it is shown in FIG. 13A, the chemicals 100 are injected through pipe 99 said chemicals merge and mix with previously drained flow 59. Chemicals 100 and drained water 59 merge at zone 60 creating a turbulence zone 34B where there is a complete dilution of chemicals; mixed flow 60 and 61 continues through channel 73 said flow is agitated by spacers 66 that are separated across machine direction which main purpose is to form channel 73 and support the T bars 68. Pipes 99 feeding the chemicals are spaced cross machine direction separated from 0.5 to 8 inches depending on the paper machine needs 4 to 6 inches is the preferred separation.

The unit may work with or without chemical addition; in case of chemical addition it is preferable to close the gate valve 38 in order to eliminate any chemical lost.

The water and chemicals mixed flow 61 and later 62 merges with new drain flow 57 and it is reintroduced 58 to the fiber suspension 1A, both flows become as flow 1B, fibers are completely saturated with chemicals at microactivity zone 55, not retained chemicals are drained as part of flow 59 in order to be reused again optimizing chemical use.

In relation to a size press it is worth to note that the chemicals added at this stage increases the dry strength of the paper with minimum refining and low fiber quality, the chemicals added at the size press are in solution at approximately 3 to 25% solids, the paper absorbs some of the sizing solution and the balance is removed at the press. The size press solution absorbed by the paper has to be eliminated with additional dryers after the size press.

FIG. 13A depicts the new forming invention showing the chemical injection.

Figure 13B:
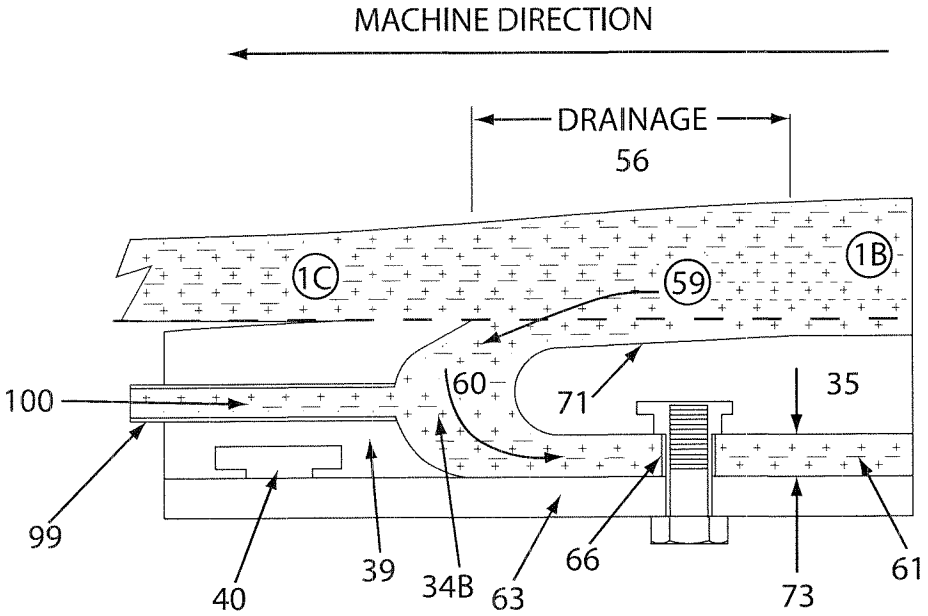
FIG. 13B Depicts the new forming invention, details the chemical injection.
Figure 14:
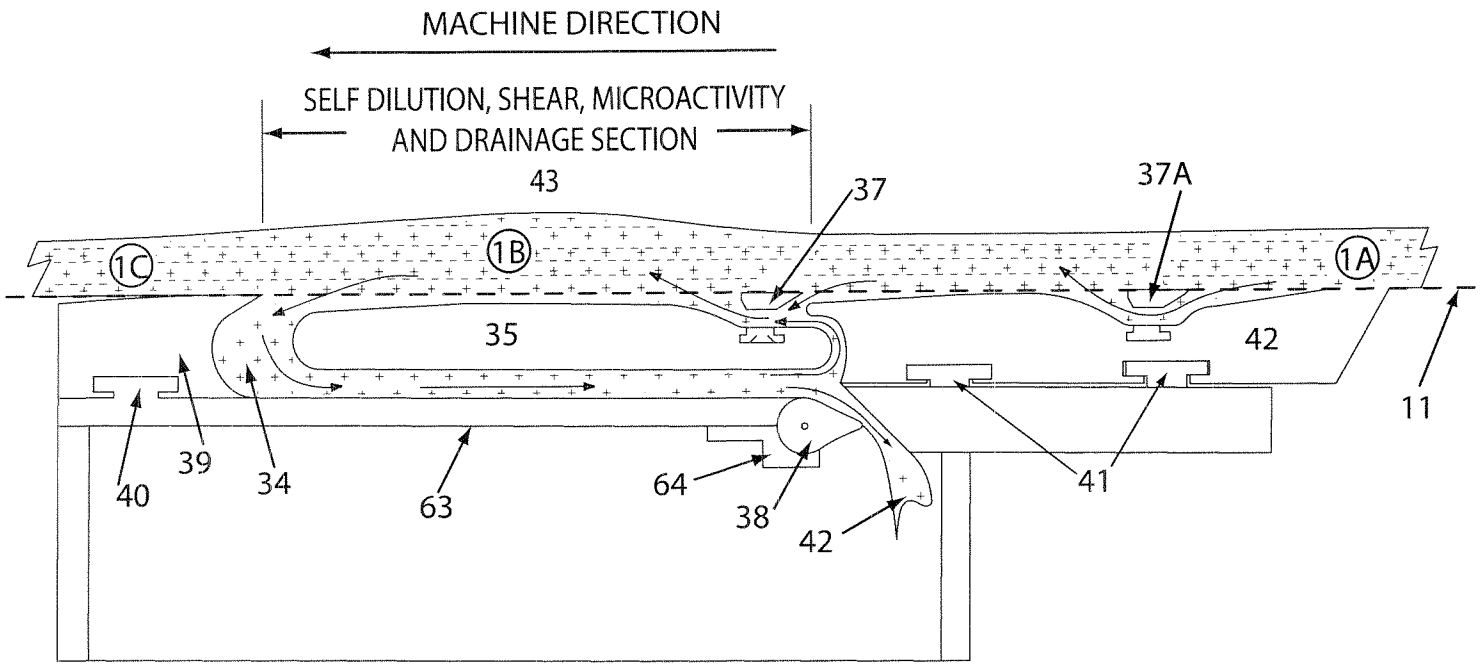
FIG. 14 Depicts another aspect of the new forming invention with different lead in blade 42.
Figure 15:
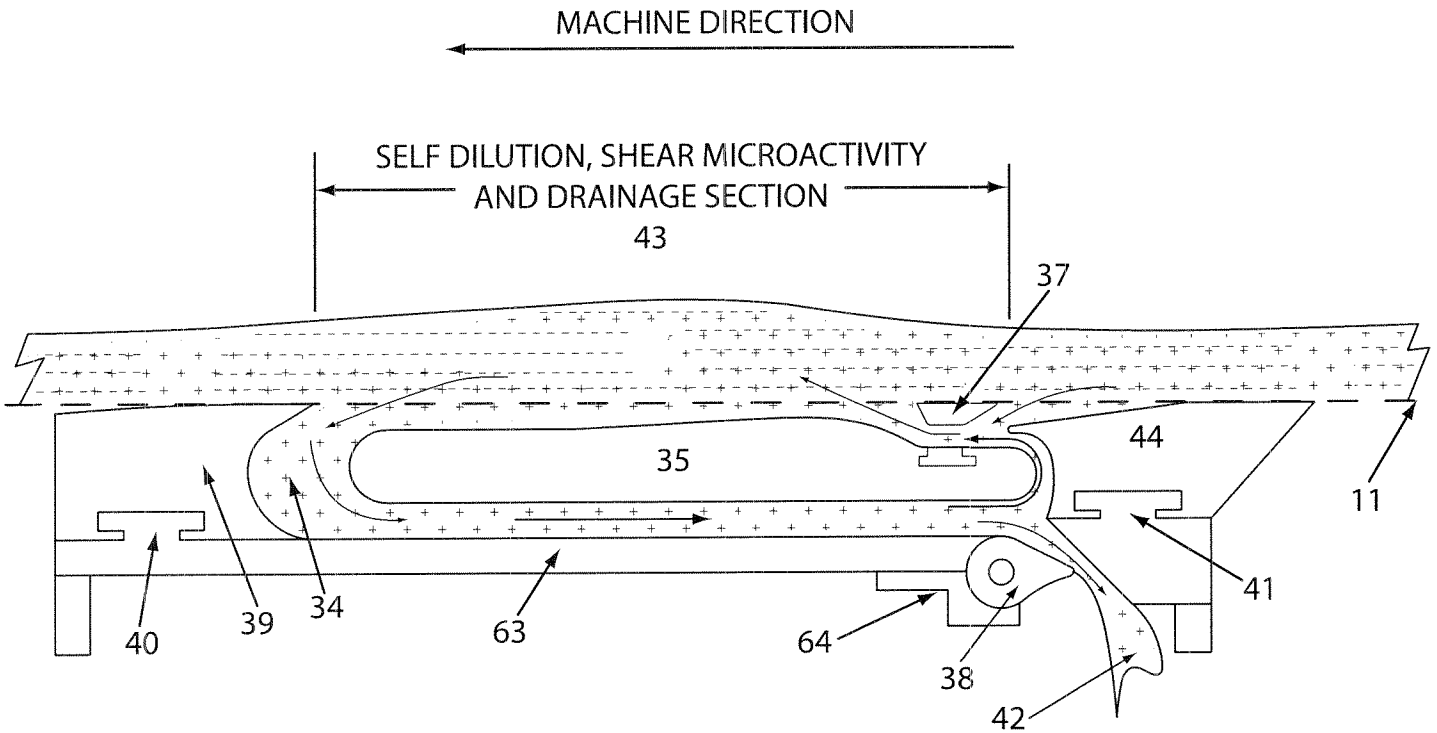
FIG. 15 Depicts another aspect of the new forming invention with different lead in blade 44.
Figure 16:
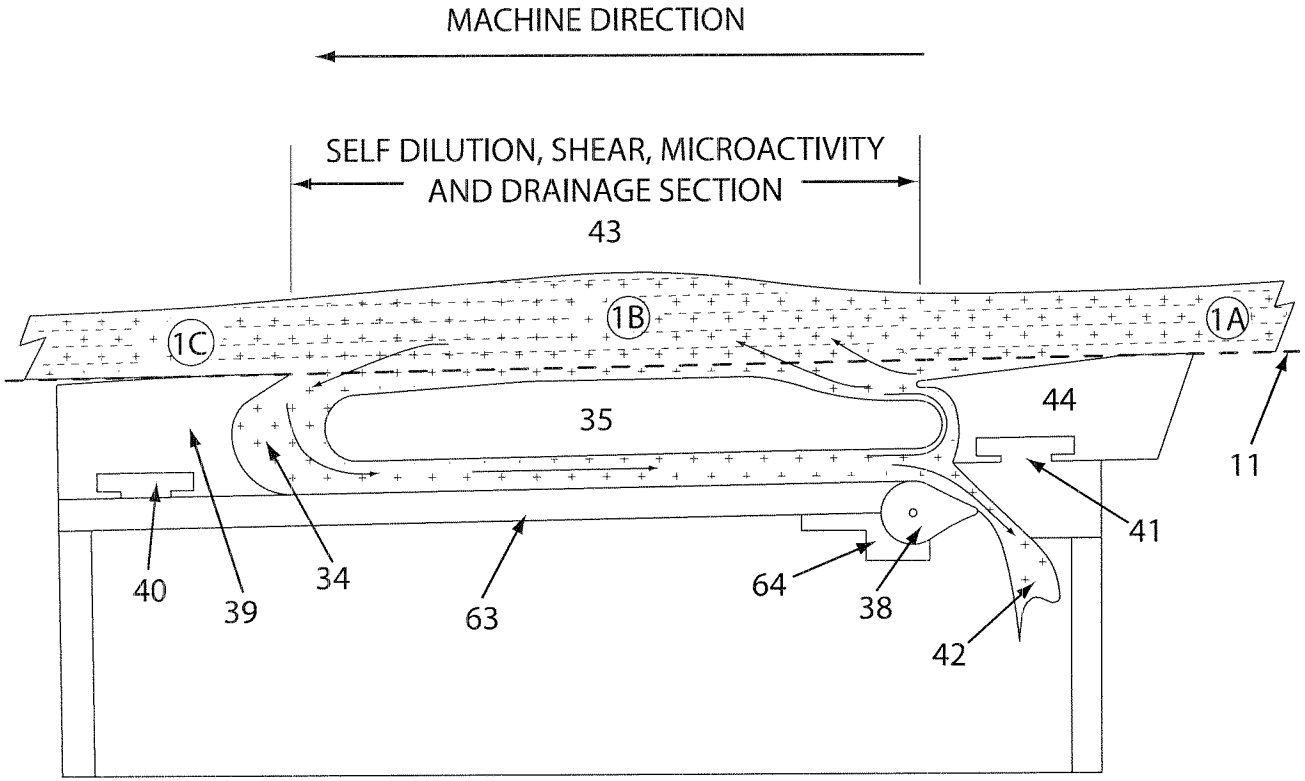
FIG. 16 Depicts another aspect of the new forming invention without support blade.
Figure 17:
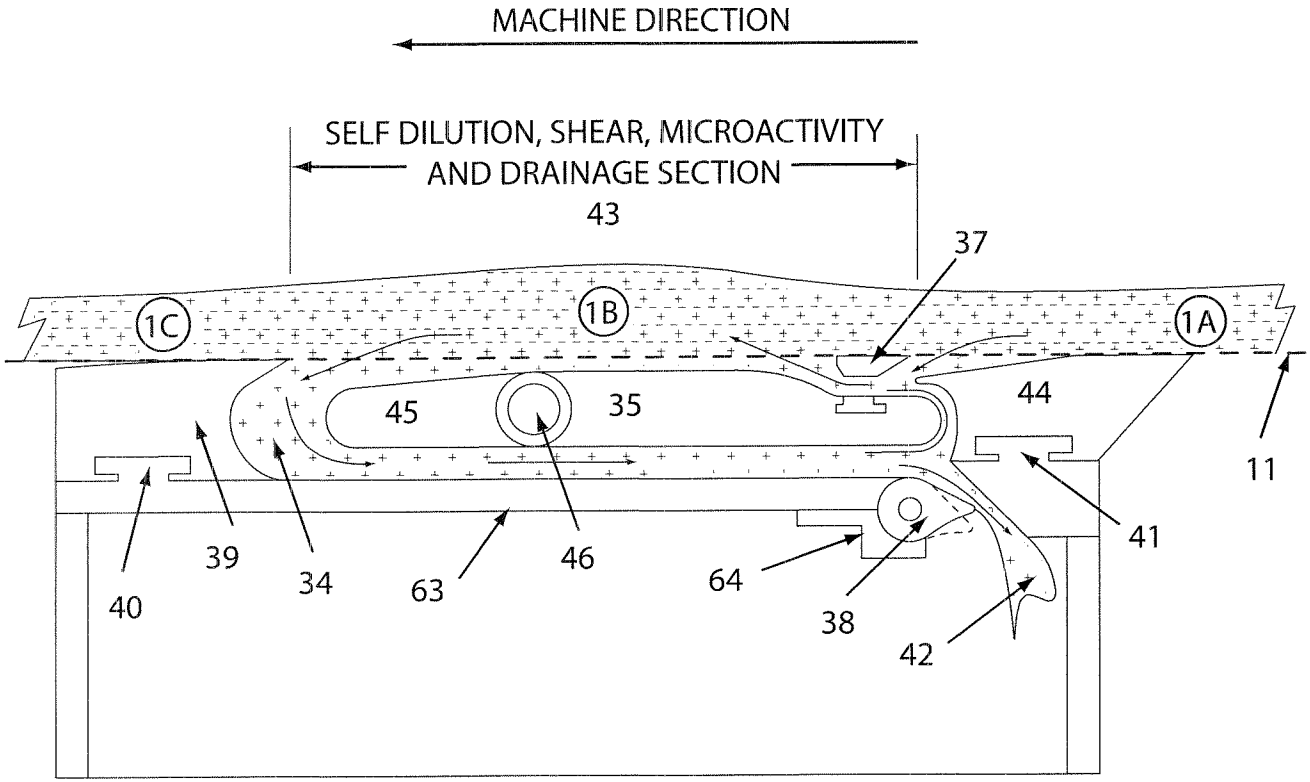
FIG. 17 Depicts another aspect of the new forming invention, the self dilution, shear, microactivity and drainage section with pivot point.
Figure 18:
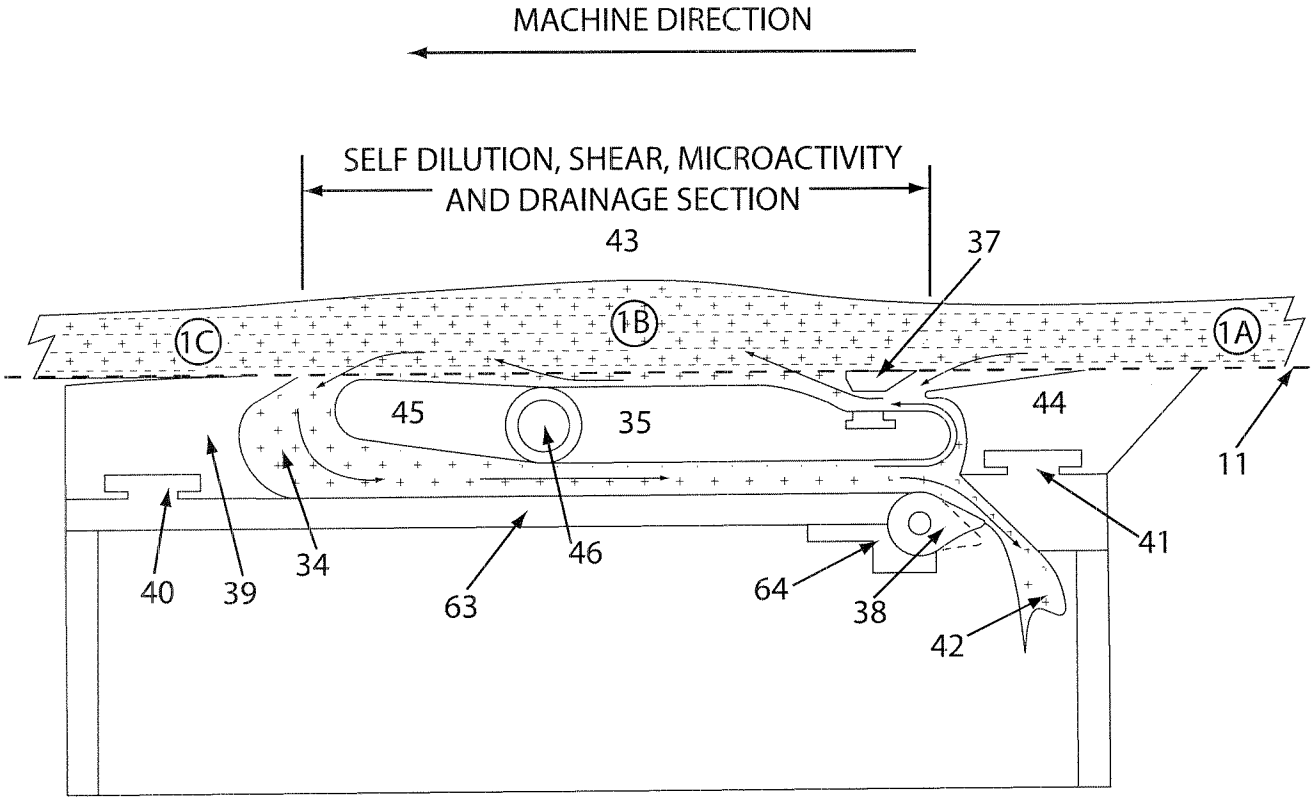
FIG. 18 Depicts another aspect of the new forming invention, the self dilution, shear, microactivity and drainage section with pivot point, changing the angle of the drainage section.
Figure 19:
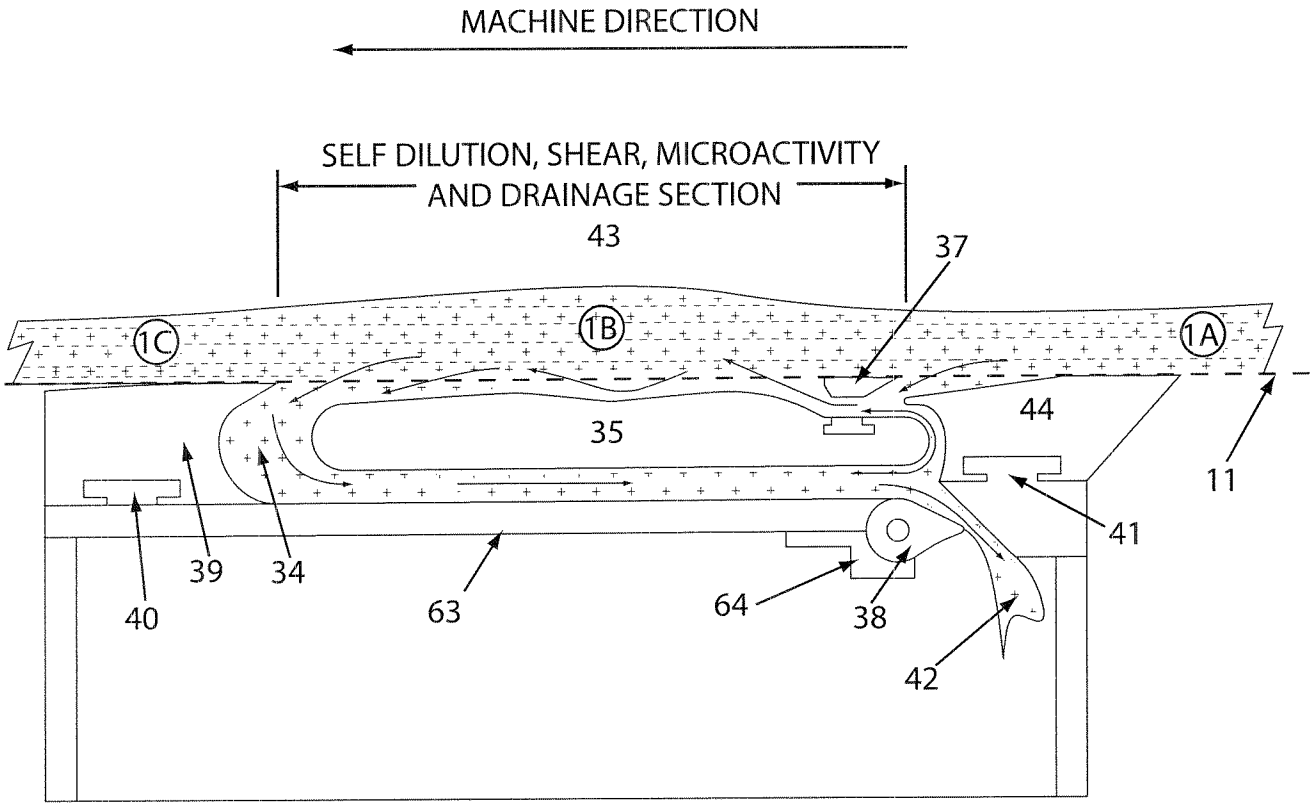
FIG. 19 Depicts another aspect of the new forming invention, details the hydraulic performance at the self dilution, shear, microactivity and drainage section with multiple converging and diverging sections.

FIG. 13B depicts the new forming invention, details the chemical injection.

The benefits of making the chemical injection at the forming table with the new invention are as follows:

1. The efficiency of the chemicals is higher as long as chemicals are not diluted because the volume that the new invention uses is minimum compared with the total volume stored at the silo.

2. The efficiency of chemicals is better because chemicals and fibers are well mixed at the microactivity zone.

3. The chemical are not subject to high shear effect like happen at the fan pump or machine screen, shear action reduces efficiency of chemicals.

4. There is considerable reduction in energy consumption when chemical added at the new invention replaces chemicals at the size press, because it is not necessary to eliminate the excess liquid absorbed by the paper.

5. There is not machine speed reduction due to rewetting of the paper sheet at size press in the dryers.

6. It is possible to control the strength of the paper in cross machine direction.

7. The response to any change in dosage is immediate because the new invention works with minimum volume of water compared to the volume of the silo.

While the invention has been described in connection with what is considered to be the most practical and preferred embodiment, it should be understood that this invention is not limited to the disclosed embodiments, but on the contrary, is intended to cover various modifications and equivalent arrangements included within the spirit and scope of the appended claims.

The invention claimed is:

1. An apparatus for lowering consistency or degree of density of fiber contained in a liquid suspension on a forming table of a papermaking machine, the apparatus comprising:

at least one conduit for adding paper making chemicals into a flow of liquid to form a mixed flow;

a forming fabric on which a fiber slurry is conveyed; the forming fabric having an outer surface and an inner surface;

a primary blade having a leading edge support surface that is in sliding contact with the inner surface of the forming fabric; and a central plate that comprises at least a portion of self dilution, shear, microactivity or drainage section of the forming table, wherein the central plate is separated from a bottom plate by a predetermined distance to form a channel for recirculation of at least a portion of the liquid.

2. The apparatus according to claim 1, comprising:

the conduit comprising at least one opening proximate to a drainage section of the forming table and configured to add the paper making chemicals into a drained flow of the liquid to form the mixed flow.

3. The apparatus according to claim 2, wherein a surface of the central plate is configured to create a turbulence zone, wherein the paper making chemicals are fed from the opening and merge with the drained flow at the turbulence zone to form a mixed flow.

4. The apparatus according to claim 2, wherein the conduit comprises:

a plurality of pipes for adding the chemicals, the pipes being separated in the cross machine direction from about 0.5 to about 8 inches.

5. The apparatus according to claim 4, wherein the pipes for adding the chemicals are separated in the cross machine direction from about 4 to about 6 inches.

6. The apparatus according to claim 4, further comprising:

a gate configured to discharge a purge flow, wherein the gate comprises a gate valve configured to be closed when the papermaking chemicals are added.

7. The apparatus according to claim 1, wherein the central plate is separated from the bottom plate by a predetermined distance using spacers and bolts or spacers and T bars separated across the machine direction, and wherein the spacers configured to form the channel.

8. The apparatus according to claim 1, wherein the apparatus is configured to allow the mixed flow including the drained liquid to be re-used in at least a part of the forming process in order to produce a desired hydrodynamic effect.

9. The apparatus according to claim 8, wherein the apparatus is configured to saturate the fibers of the liquid suspension with the paper making chemicals from the mixed flow.

10. The apparatus according to claim 9, wherein the fibers of the liquid suspension are saturated with the paper making chemicals of the mixed flow at the microactivity zone.

11. The apparatus of claim 1 wherein the chemicals are added at a size press, and the chemicals are added to form a solution of about 3% to 25% solids.

12. The apparatus of claim 1 wherein the chemicals are added after the forming table.

13. The apparatus of claim 1 wherein the chemicals are added before the forming table.

14. A system for lowering consistency or degree of density of fiber contained in a liquid suspension on a forming table of a papermaking machine, the system comprising an apparatus comprising:

at least one conduit for adding paper making chemicals into a flow of liquid;

a forming fabric on which a fiber slurry is conveyed; the forming fabric having an outer surface and an inner surface;

a primary blade having a leading edge support surface that is in sliding contact with the inner surface of the forming fabric; and a central plate that comprises at least a portion of self dilution, shear, microactivity or drainage section of the forming table, wherein the central plate is separated from a bottom plate by a predetermined distance to form a channel for recirculation of at least a portion of the liquid.

15. A method for lowering consistency or degree of density of fiber suspension on a forming table of a papermaking machine, the method comprising:

providing at least one conduit for adding paper making chemicals into a flow of liquid for form a mixed flow;

providing a forming fabric on which a fiber slurry is conveyed; the forming fabric having an outer surface and an inner surface;

providing a primary blade having a leading edge support surface that is in sliding contact with the inner surface of the forming fabric; and providing a central plate that comprises at least a portion of self dilution, shear, microactivity or drainage section of the forming table, wherein the central plate is separated from a bottom plate of the forming table by a predetermined distance to form a channel for recirculation of at least a portion of a liquid.

16. The method of claim 15, wherein the method further comprises:

configuring the conduit to add the paper making chemicals into the drained flow of the liquid to form the mixed flow.

17. The method of claim 15, wherein the method further comprises:

configuring the central plate to create a turbulence zone such that the paper making chemicals merge with the drained flow at a turbulence zone to form the mixed flow.

18. The method of claim 15, wherein the method further comprises:

separating the central plate from the bottom plate by a predetermined distance using spacers and bolts or spacers and T bars separated across the machine direction, and wherein the spacers configured to form the channel, whereby the spacers are configured to agitate the mixed flow.

19. The method of claim 15, wherein the method further comprises:

providing the conduit comprising a plurality of pipes for adding the chemicals, and separating the pipes in the cross machine direction at from about 0.5 to about 8 inches.

20. The method of claim 19, wherein the method further comprises:

separating the plurality of pipes in the cross machine direction at from about 4 to about 6 inches.

21. The method of claim 15, wherein the method further comprises:

configuring the papermaking machine such that mixed flow including the drained liquid to be re-used in at least a part of the forming process.

22. The method of claim 21, wherein the method further comprises:

configuring the papermaking machine to saturate the fibers of the liquid suspension with the paper making chemicals from the mixed flow.

23. The method of claim 22, wherein the method further comprises:

configuring the papermaking machine such that the fibers of the liquid suspension are saturated with the paper making chemicals of the mixed flow at a microactivity zone.

24. The method of claim 15, wherein the method further comprises:

configuring the papermaking machine such that the chemicals are added after the forming table.

25. The method of claim 15, wherein the method further comprises:

configuring the papermaking machine such that chemicals are added before the forming table.

* * * * *